US010060582B2

(12) United States Patent
O'Brien

(10) Patent No.: US 10,060,582 B2
(45) **Date of Patent: *Aug. 28, 2018**

(54) MODULAR FLASHLIGHT SYSTEM WITH RETENTION DEVICE

(71) Applicant: TACTICAL IMPULSE LLC, Arlington, TX (US)

(72) Inventor: Paul O'Brien, Arlington, TX (US)

(73) Assignee: TACTICAL IMPULSE LLC, Arlington, TX (US)

( * ) Notice: Subject to any disclaimer, the term of this patent is extended or adjusted under 35 U.S.C. 154(b) by 31 days.

This patent is subject to a terminal disclaimer.

(21) Appl. No.: 14/728,151

(22) Filed: Jun. 2, 2015

(65) Prior Publication Data

US 2015/0267882 A1 Sep. 24, 2015

Related U.S. Application Data

(63) Continuation-in-part of application No. 13/749,636, filed on Jan. 24, 2013, now Pat. No. 9,046,230.

(60) Provisional application No. 61/589,944, filed on Jan. 24, 2012.

(51) Int. Cl.

| | |
|---|---|
| ***F21L 4/08*** | (2006.01) |
| ***F21V 23/04*** | (2006.01) |
| ***F21L 4/00*** | (2006.01) |
| *F21Y 115/10* | (2016.01) |

(52) U.S. Cl.

CPC ..... *F21L 4/085* (2013.01); *F21L 4/005* (2013.01); *F21L 4/08* (2013.01); *F21V 23/0442* (2013.01); *F21V 23/0421* (2013.01); *F21Y 2115/10* (2016.08)

(58) Field of Classification Search

CPC ... F21L 4/005; F21L 4/02; F21L 4/022; F21L 4/025; F21L 4/027; F21L 4/08; F21L 4/085; F21V 23/0421; F21V 23/0442; H02J 7/0031; H02J 7/0044; H02J 7/0045

See application file for complete search history.

(56) References Cited

U.S. PATENT DOCUMENTS

| | | | | |
|---|---|---|---|---|
| 2,253,315 A * | 8/1941 | Andrus | F21L 7/00 231/7 |
| 2,942,102 A * | 6/1960 | Stoutenburgh | F21L 4/00 362/157 |
| 5,081,568 A * | 1/1992 | Dong | F21L 4/02 340/321 |
| 5,197,796 A | 3/1993 | Moore | |
| 5,536,979 A | 7/1996 | McEachern et al. | |
| 5,806,961 A * | 9/1998 | Dalton | F21L 4/025 362/183 |
| 5,909,952 A * | 6/1999 | Guthrie | F21L 11/00 362/184 |
| 6,013,985 A | 1/2000 | Green et al. | |
| 6,043,626 A | 3/2000 | Snyder et al. | |
| 6,099,141 A * | 8/2000 | Landamia | B60Q 3/007 362/157 |
| 6,179,438 B1 * | 1/2001 | Parker | F21L 4/085 362/183 |
| 6,193,546 B1 * | 2/2001 | Sadler | A45F 5/02 439/165 |

(Continued)

*Primary Examiner* — Alan Cariaso
(74) *Attorney, Agent, or Firm* — Gregory M. Howison

(57) ABSTRACT

A modular flashlight and a modular flashlight system are provided. In one example, the modular flashlight includes a base configuration that can be modified with a modular extension unit.

11 Claims, 25 Drawing Sheets

(56) References Cited

U.S. PATENT DOCUMENTS 6,350,040 B1 * 2/2002 Parker ..... H02J 7/0042 320/113
6,633,152 B2 * 10/2003 Sharrah ..... F21L 4/08 320/114
6,652,115 B2 * 11/2003 Sharrah ..... F21L 4/085 320/113
6,652,116 B2 11/2003 Dickinson
6,857,756 B2 * 2/2005 Reiff ..... F21L 4/04 362/183
6,874,907 B2 * 4/2005 Liao ..... F21L 4/08 362/183
7,121,688 B2 10/2006 Rempel
7,393,120 B2 7/2008 Kang et al.
7,394,220 B2 * 7/2008 Huang ..... H02J 7/0045 320/107
7,422,344 B2 9/2008 Wu et al.
7,527,388 B2 5/2009 Kim
7,631,984 B2 12/2009 Martin et al.
7,635,197 B2 12/2009 Man
7,641,358 B1 * 1/2010 Smith ..... F21L 4/08 315/307
7,651,239 B2 * 1/2010 Spartano ..... F21L 4/005 362/184
7,674,003 B2 * 3/2010 Sharrah ..... H01H 13/503 362/202
7,696,728 B2 * 4/2010 Cross ..... A61C 17/224 320/112
8,013,572 B2 * 9/2011 Rodgers ..... H02J 7/0044 320/103
8,086,281 B2 * 12/2011 Rabu ..... G06F 1/1632 455/571
8,169,185 B2 * 5/2012 Partovi ..... H01F 5/003 320/108
8,231,474 B2 * 7/2012 Stethem ..... F41B 15/02 463/47.3
8,246,193 B2 * 8/2012 Weng ..... F21L 4/00 362/157
2005/0264261 A1 * 12/2005 Barbeau ..... F21L 2/00 320/114
2006/0034078 A1 * 2/2006 Kovacik ..... F21L 4/08 362/227
2007/0247105 A1 * 10/2007 Krieger ..... H02J 7/0006 320/104
2008/0055891 A1 3/2008 Mattheis
2010/0039792 A1 * 2/2010 Meyers ..... F21L 2/00 362/20
2012/0188753 A1 * 7/2012 Popper ..... H02J 7/0044 362/183
2013/0343042 A1 * 12/2013 Windom ..... F21L 4/08 362/183

* cited by examiner

MODULAR FLASHLIGHT SYSTEM WITH RETENTION DEVICE

CROSS-REFERENCE TO RELATED APPLICATIONS

This application is a Continuation-In-Part of U.S. patent application Ser. No. 13/749,636, filed on Jan. 24, 2013, entitled MODULAR FLASHLIGHT SYSTEM, published as U.S. Patent Application Publication No. 2013/0265749, published on Oct. 10, 2013. U.S. application Ser. No. 13/749,636 claims benefit of U.S. Provisional Application No. 61/589,944, filed Jan. 24, 2012, and entitled LED FLASHLIGHT SYSTEM. The specifications of U.S. patent application Ser. No. 13/749,636, U.S. Patent Application Publication No. 2013/0265749, and U.S. Provisional Application No. 61/589,944 are incorporated herein by reference in their entirety.

BACKGROUND

Flashlights are expected to provide reliability in their primary function of area illumination. Reliable functionality is particularly important for the military and first responders such as police officers, firefighters, and other emergency service personnel who are expected to discharge their duties regardless of the conditions in which they find themselves. Many military, first responder, and other professionals carry their flashlights whenever they are on duty and may use them for any number of tasks in addition to area illumination even though their flashlights may not be well suited for such tasks. Accordingly, improvements are needed to provide additional functionality to flashlights.

BRIEF DESCRIPTION OF THE DRAWINGS

For a more complete understanding, reference is now made to the following description taken in conjunction with the accompanying Drawings in which.

DETAILED DESCRIPTION

Figure 1A:
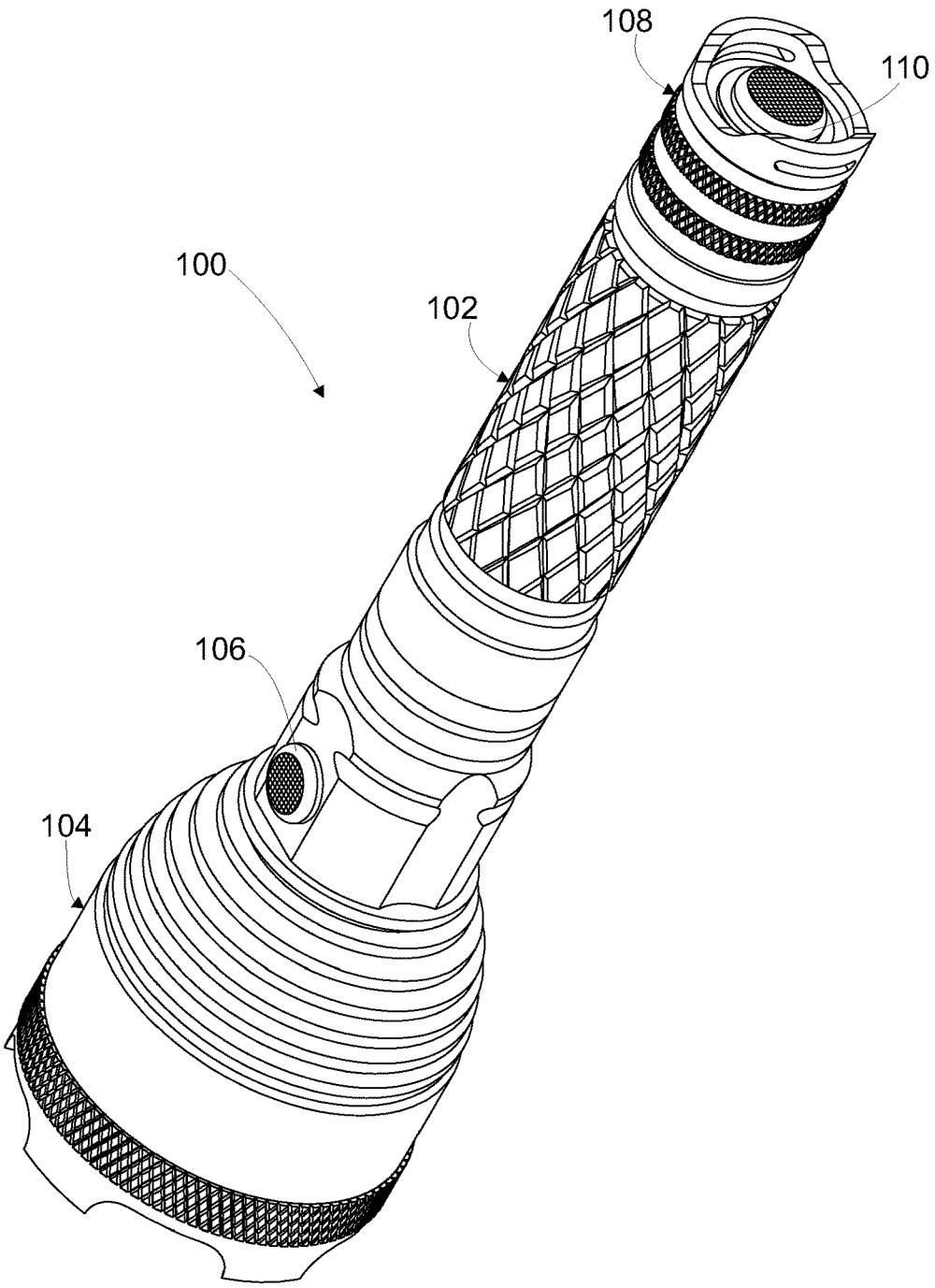
FIG. 1A illustrates a perspective view of one embodiment of a flashlight.

Referring now to the drawings, wherein like reference numbers are used herein to designate like elements throughout, the various views and embodiments of a modular flashlight and a modular flashlight system are illustrated and described, and other possible embodiments are described. The figures are not necessarily drawn to scale, and in some instances the drawings have been exaggerated and/or simplified in places for illustrative purposes. One of ordinary skill in the art will appreciate the many possible applications and variations based on the following examples of possible embodiments.

Figure 1B:
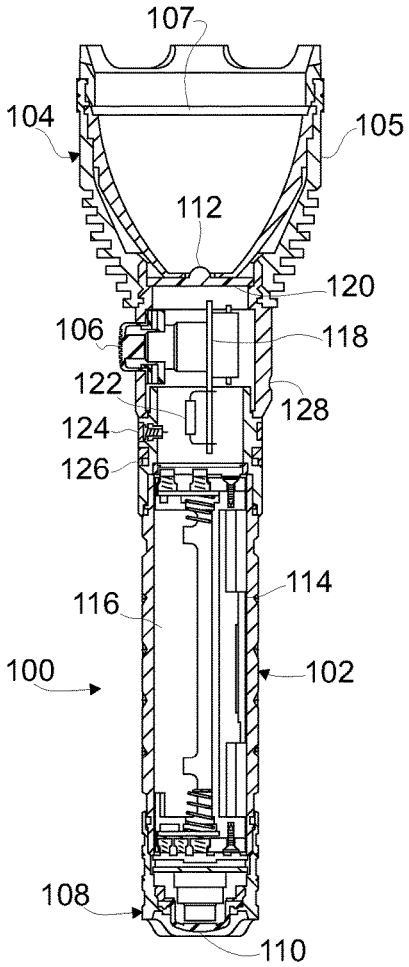
FIG. 1B illustrates a cross-sectional view of one embodiment of the flashlight of FIG. 1A.

Referring to FIGS. 1A and 1B, one embodiment of a modular flashlight 100 is illustrated in a non-limiting base configuration embodiment. As will be described in detail in the following disclosure, the flashlight 100 may be operated in the base configuration and may also be reconfigured from the base configuration embodiment with various modular extension units to provide additional functionality depending on which modular extension unit is used with the base configuration. The modular extension units are easily transportable and may be attached and detached as needed. In some embodiments, a modular extension unit may provide functions that are not provided by the base configuration embodiment of the flashlight 100. In other embodiments, a modular extension unit may support the base configuration without providing additional functionality.

In the embodiment shown in FIGS. 1A and 1B, the flashlight 100 includes a base configuration that is formed by a substantially cylindrical housing 102 coupled to or including a head 104. It is understood that the housing 102 and head 104 may overlap or otherwise merge in different ways depending on the particular design of the flashlight 100 and that the head may also be part of or integral with the body. Accordingly, features described herein as positioned in, on or near the head 104 may be in or on the housing 102 in some embodiments, or vice versa.

The base configuration embodiment includes a head mounted switch 106 positioned on or near the head 104. The illustrated base configuration embodiment also includes a tail cap 108 having a tail mounted switch 110. Accordingly, the base configuration embodiment provides the two switches 106 and 110, either of which can toggle a light source 112.

The head 104 provides a substantially conical covering 105 and a lens 107 configured to protect a light source 112 that is coupled to the housing 102. In some embodiments, the covering 105 may have a reflective interior coating and be shaped to direct light from the flashlight 100. The light source 112 is a light emitting diode (LED) in the present embodiment, but it is understood that other types of light sources may be used such as incandescent, halogen and fluorescent light sources. A single LED is used for purposes of example in parts of this disclosure, however, it is understood and expressly noted that multiple LEDs may be used.

The LED 112 (or other type of light source) may be cycled through two or more states using either of the switches 106 and 110. In the present embodiment, the states include an OFF state and multiple ON states, such as a HIGH state, a MEDIUM state, a LOW state, and a STROBE state. The HIGH, MEDIUM, and LOW states indicate relative output intensity of the LED 112. The STROBE state provides an automated varying output intensity that may range from the HIGH state to the LOW state or OFF state, or may be based on other states (e.g., HIGH to MEDIUM or MEDIUM to LOW). The STROBE state may be configured to increase and/or decrease in intensity (e.g., pulse) until the next state is reached and/or may flip directly between states (e.g., flash).

One or both of the switches 106 and 110 may differentiate between levels of pressure, or number of cycles or other operations applied to the switch. For example, a relatively light pressure may actuate the switch and activate the LED 112, but such pressure may be continually required if the LED 112 is to remain activated (e.g., in this mode the switch serves as a momentary contact switch such as a "push-to-make" switch). Removal of the pressure will turn off the LED 112. A higher level of pressure that crosses a pressure threshold may actuate the switch and result in constant activation of the LED 112 even when the pressure is removed (e.g., the switch serves as a constant contact switch). The LED 112 may remain on until an amount of pressure that also crosses the pressure threshold is again applied to deactivate the LED 112. The application of pressure great enough to cross the pressure threshold may result in feedback (e.g., tactile feedback and/or audio feedback, such as a "click" sound) to provide the user with an indication that the LED 112 is locked in the ON state. Alternatively, one or both switches may be configured to respond to multiple presses or other action to activate the LED 112 or level of the LED 112.

Referring specifically to FIG. 1B, a cross-sectional view of the housing 102 and head 104 is illustrated for a base configuration embodiment. In the illustrated embodiment, the housing 102 includes a cavity 114, which may be accessed by removal of the tail cap 108. The cavity 114 is configured to receive a battery holder 116, which will be described in greater detail below. It is understood that in some embodiments, cavity 114 may be configured to receive a stand-alone battery, wherein each of its first end and second end contain both positive and negative polarity. In the present embodiment, one or more batteries in the battery holder 116 provide power for a control board 118 and an LED board 120. The control board 118 provides functionality for receiving switch input, providing state transitions (e.g., OFF, HIGH, MEDIUM, LOW, and STROBE), and activating/deactivating the LED 112. The LED board 120 drives the LED 112. It is understood that additional circuit boards may be used, the circuit boards 118 and 120 may be combined, and/or functionality may be distributed differently than is described in the illustrated embodiment.

A sensor 122 may be coupled to the control board 118 to provide automatic shutoff and optionally automatic activation functionality to the flashlight 100. As will be described later, a retention device (e.g., a holster, a cradle, a sling or the like) or another device (e.g., a recharging unit or base station) that is configured for the flashlight 100 may include a component capable of being sensed by the sensor 122 (e.g., a ferrous material, a magnet, tag, or emitter) matched to the sensor 122. In the present non-limiting example, the sensor 122 is a magnetically actuated sensor that responds to the presence of a magnetic field (e.g., a Reed switch or hall effect sensor) and the matching component would generate a magnetic field detectable by the sensor 122 when the flashlight 100 is properly holstered or placed into the recharging unit. In other embodiments, the location of the sensor and corresponding component may be switched between the flashlight 100 and the retention device. In other embodiments, a feature on the flashlight may engage with a component or switch in the retention device, or vice versa, to provide the function of detecting when the flashlight 100 is properly holstered or placed into the recharging unit or other retention device, or removed from retention device or recharging unit. In still other embodiments, a radio frequency identification (RFID) reader or other types of sensors may be used as long as the component in the holster or recharging unit is of the proper type (e.g., an RFID tag).

In operation, in the base configuration embodiment, when the sensor 122 detects the presence of the magnetic field or other element matched to the sensor 122, the sensor 122 will, in one embodiment, shut off the LED 112 if the LED is on. This may save time for a user while discontinuing use of the flashlight 100 since the user can simply holster or cradle the flashlight 100 and does not have to manually actuate one of the switches 106 or 110. Likewise, in the base configuration embodiment, if the LED 112 is off when the sensor 122 detects the presence of the magnetic field or other element matched to the sensor 122, the sensor 122 in conjunction with the system will prevent switches 106 and 110 from activating the LED 112. This may prevent inadvertent activation of the LED 112 when holstered.

In another embodiment, the controller board 118 and sensor 122 are configured to operate so that when the flashlight 100 is inserted in the retention device, the controller operates to change the state of the flashlight to off if it is on. Further, in optional operating configurations, if the flashlight 100 is on when it is inserted into the retention device, the controller operates to memorize the current output mode and on/off state of the flashlight (e.g., LOW, MEDIUM, HIGH, STROBE) and to turn off the flashlight 100. When the flashlight 100 is then subsequently removed from the retention device, the controller, having memorized the on/off state and output mode of the flashlight when it was inserted into the retention device turns the flashlight on in the memorized on/off state and output mode of the flashlight.

In another embodiment, the controller board 118 and sensor 122 are configured to operate so that when the flashlight 100 is removed from the retention device, the flashlight automatically turns on to either a predetermined setting (e.g., HIGH) or a user selected setting.

In another embodiment, controller board 118 and sensor 122 are configured to operate so that when the flashlight 100 is inserted in the retention device, power to the light source is interrupted thereby stopping the illumination produced by the flashlight, but the controller board 118 and sensor 122 do not change the current mode of operation. In this way, when the flashlight is removed from the retention device, power to the light source is restored and the flashlight resumes producing illumination at the same mode as before.

In the base configuration embodiment, contacts 124 and 126 may completely or partially encircle the flashlight 100. As will be described later, the contacts 124 and 126 may be used to electrically couple the battery holder 116, or in some embodiments, a stand-alone battery wherein each of its first end and second end contain both positive and negative polarity, to a recharging unit. One or more notches 128 may be positioned on or near the head 104 or other part of the flashlight 100 that engages with the retention unit. As will be described later, the notches 128 may be used to position the flashlight 100 within a retention device and/or to align and seat the contacts 124 and 126 with contacts in the recharging unit.

Figure 2A:
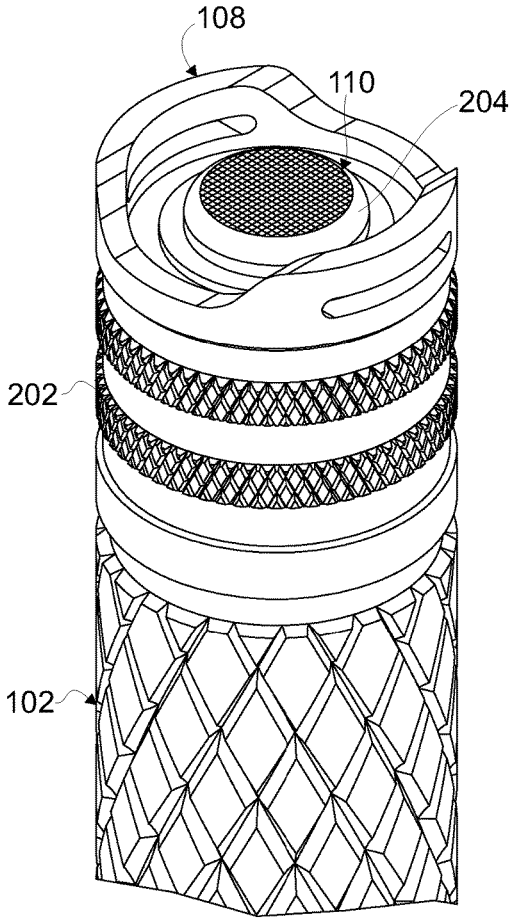
FIG. 2A illustrates a perspective view of one embodiment of a tail cap that may form part of the flashlight of FIG. 1A.
Figure 2B:
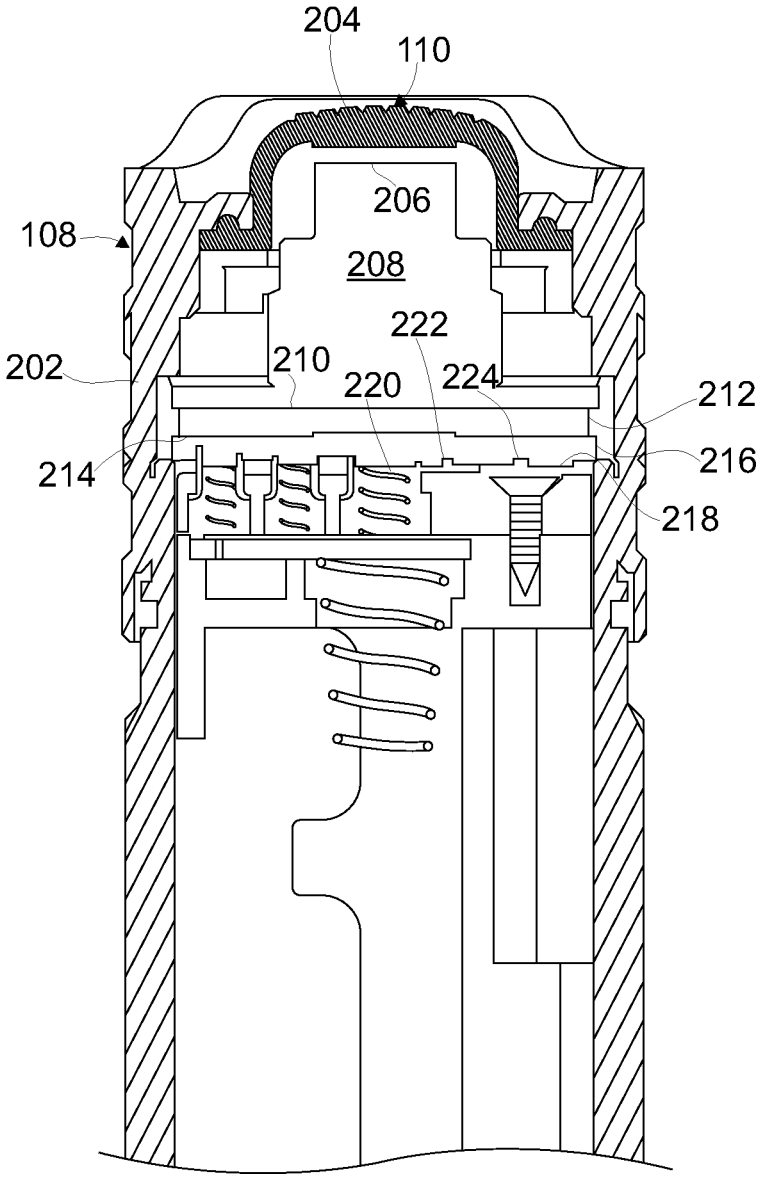
FIGS. 2B and 2C illustrate cross-sectional views of one embodiment of the tail cap of FIG. 2A.
Figure 2C:
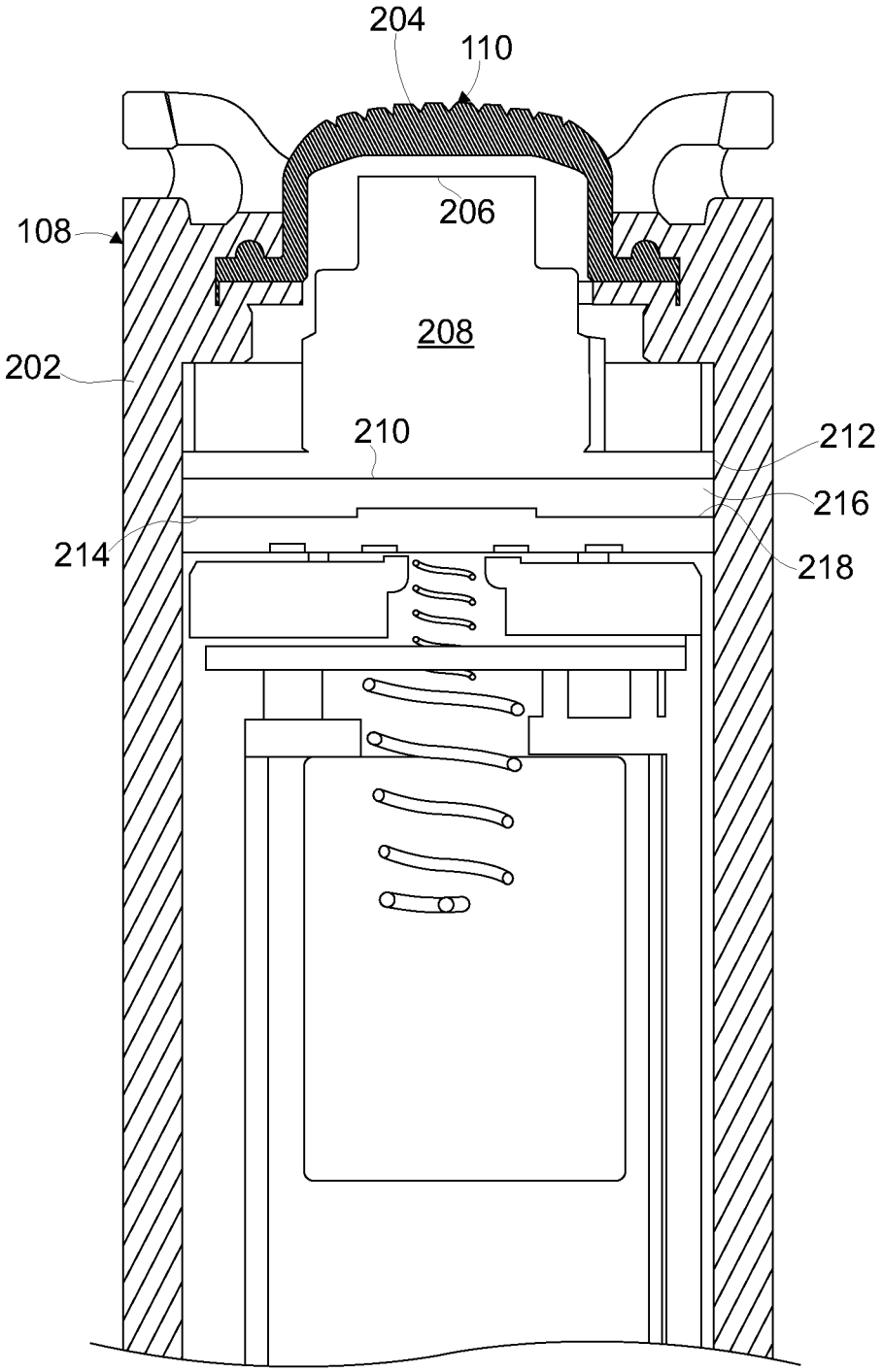

Referring to FIGS. 2A-2C, an embodiment of the tail cap 108 is illustrated. The tail cap 108 includes a housing 202 that forms a support platform for the switch 110. The switch 110 may include a switch cover 204 that engages an upper surface 206 of a switch mechanism 208 when actuated. Actuation of the switch 110 sends a signal to the control board 118, enabling the switch 110 to control the LED 112.

In one embodiment, a lower surface 210 of the switch mechanism 208 forms a cavity 212 with an upper surface 214 of a lower member 216. The cavity 212 is sized to provide a gap between the lower surface 210 and the upper surface 214. Conductive traces and/or contacts may be provided on the upper surface 214 and, in some embodiments, on the lower surface 210. When the switch mechanism 208 is pressed, the gap is lessened and the switch actuation can be detected. For example, the middle of the lower surface 210 may contact the middle of the upper surface 214, completing a circuit via a contact 220. A lower surface 218 of the lower member 216 is configured to electrically engage the battery holder 116. The lower surface 218 includes three separate contacts 220, 222, and 224 (e.g., partial or complete concentric metal circles and/or other contact shapes) that are positioned to engage opposing contacts on the battery holder 116. As will be described below, the lower surface 218 provides contacts and traces that are needed to complete the main circuit in order for the flashlight 100 to operate.

Figure 3A:
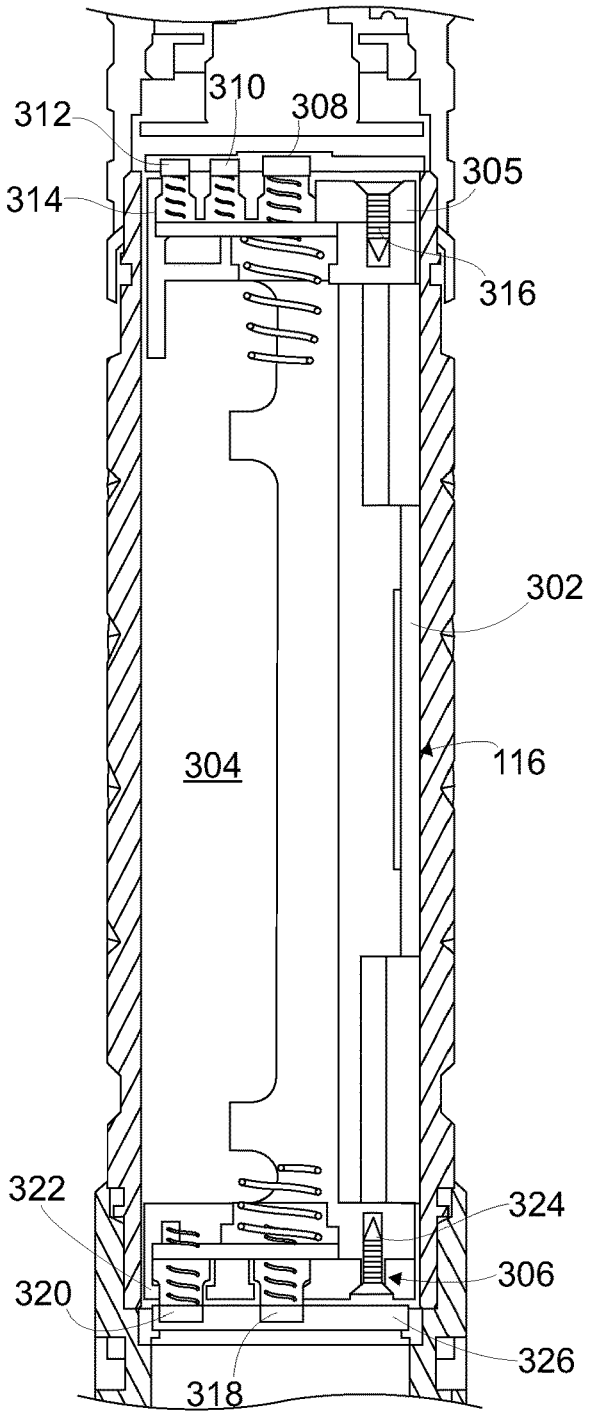
FIGS. 3A and 3B illustrate cross-sectional views of one embodiment of a battery holder that may form part of the flashlight of FIG. 1A.
Figure 3B:
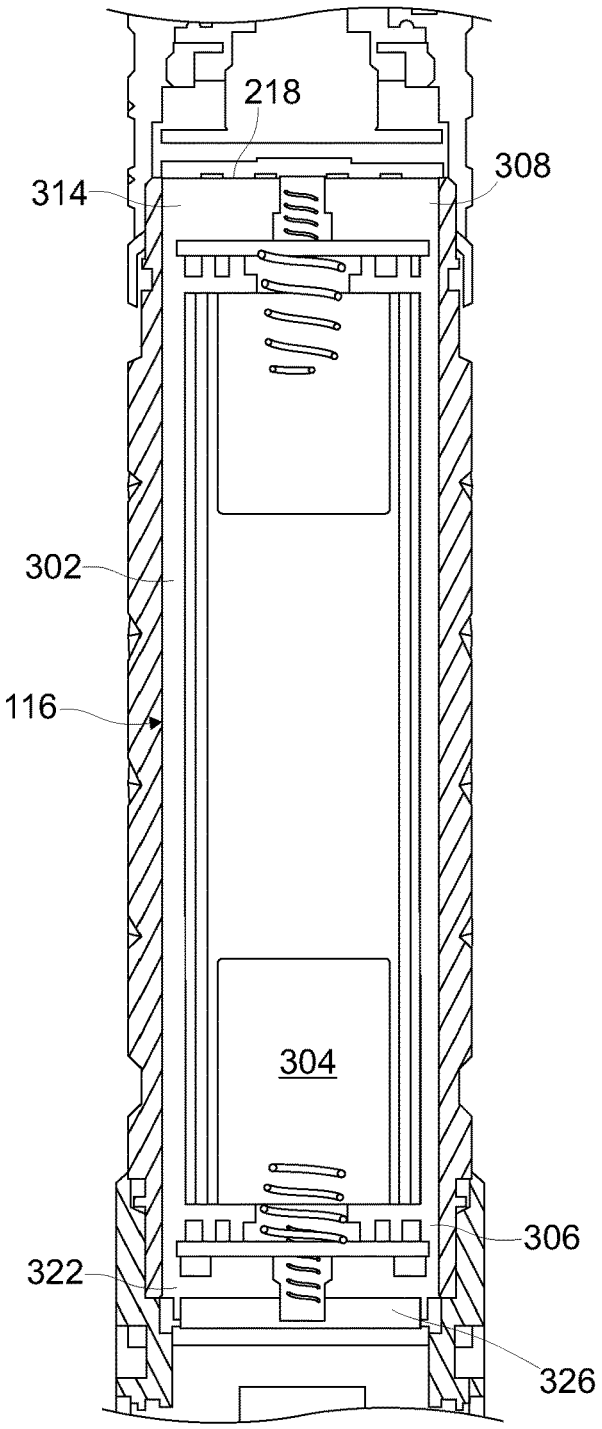

Referring to FIGS. 3A and 3B, one embodiment of the battery holder 116 is illustrated in greater detail. In the embodiment, the battery holder 116 includes a removable battery housing 302 with an interior cavity 304 sized to receive a battery (not shown). Although the present embodiment uses a rechargeable Lithium Ion (Li-ion) battery such as an 18650, it is understood that the battery holder 116 may be configured to receive many different rechargeable or non-rechargeable battery types and sizes. One end 305 of the battery holder 116 abuts the tail cap 108 and the other end 306 faces the control board 118. Both ends 305 and 306 provide a positive terminal and a negative terminal. For example, the end 305 may include a main negative contact 308 and an additional positive/negative contact pair 310 and 312. The end 306 may include a main positive contact 318 and an additional negative contact 320. It is understood that the polarity and position of a particular contact may be different in other embodiments, as long as both ends 305 and 306 provide both a positive terminal and a negative terminal. Traces (not shown) run along the battery housing 302 to provide power and/or signal paths between the ends 305 and 306. This enables the battery holder 116 to provide power to the two circuit boards 118 and 120 and also to provide power to and/or receive power from a module that is used to replace the tail cap 108. It is understood that it some embodiments, a stand-alone battery may be configured to provide power to the two circuit boards 118 and 120 and also to provide power to and/or receive power from a modular extension, without need for a battery holder.

In the present embodiment, the end 305 includes three contacts 308, 310, and 312 that extend through an end cap 314 and are positioned to contact the three contacts on the lower surface 218 of the tail cap 108. In some embodiments, the contacts 308, 310, and 312 may be spring loaded to ensure that they securely engage the contacts in the tail cap 108 while allowing for some depression into the battery holder 116. The end cap 314 may be coupled to the housing 302 using a screw 316 or other coupling mechanism.

The end 306 includes two contacts 318 and 320 that extend through an end cap 322 and are positioned to contact two contacts positioned on a substrate 326 of the housing 102. The substrate 326 is electrically coupled to the control board 118 and supplies power from the contacts 318 and 320 to the control board 118. In some embodiments, the contacts 318 and 320 may be spring loaded to ensure that they securely engage the contacts on the substrate 326 while allowing for some depression into the battery holder 116. The end cap 322 may be coupled to the housing 302 using a screw 324 or other coupling mechanism.

Figure 4:
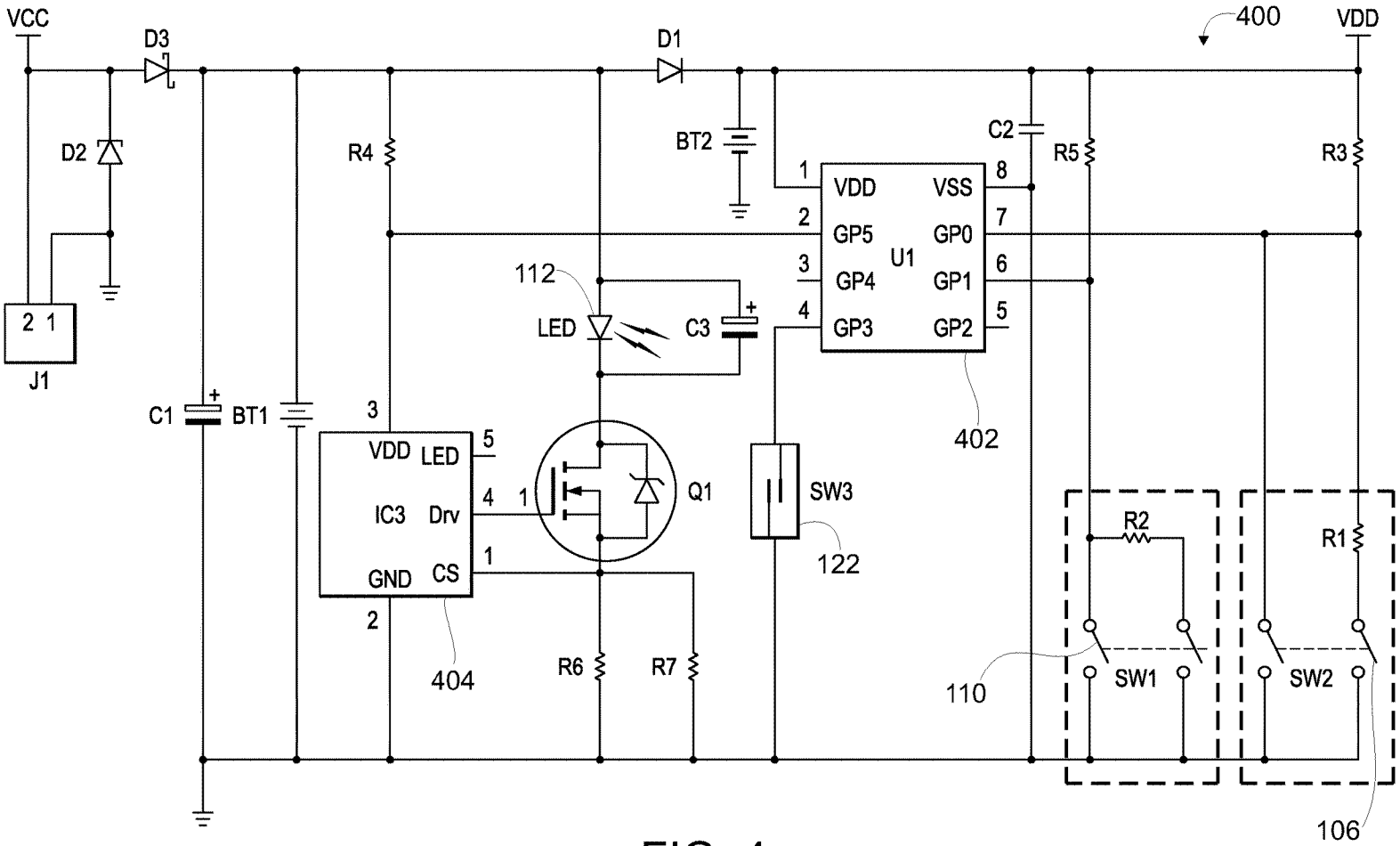
FIG. 4 illustrates a diagram of one embodiment of a circuit that may be used in the flashlight of FIG. 1A.
Figure 5A:
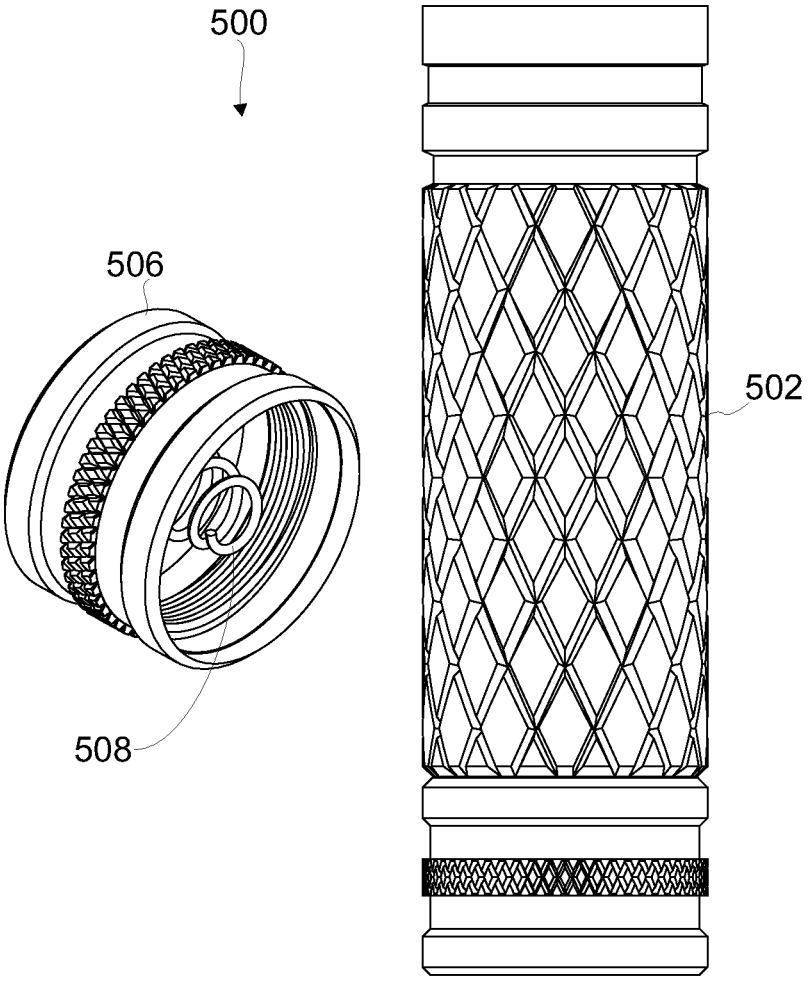
FIG. 5A illustrates one embodiment of a modular extension unit that may be used with the flashlight of FIG. 1A.
Figure 5B:
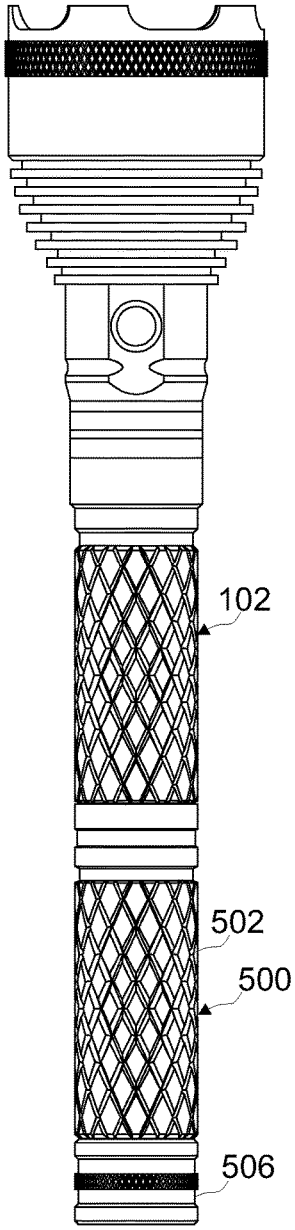
FIGS. 5B and 5C illustrate side and cross-sectional views, respectively, of embodiments of the modular extension unit of FIG. 5A coupled to the flashlight of FIG. 1A.
Figure 5C:
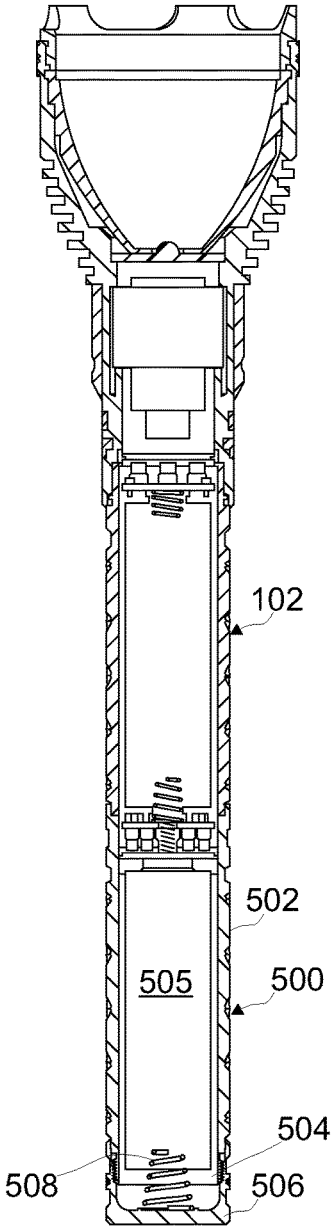
Figure 5D:
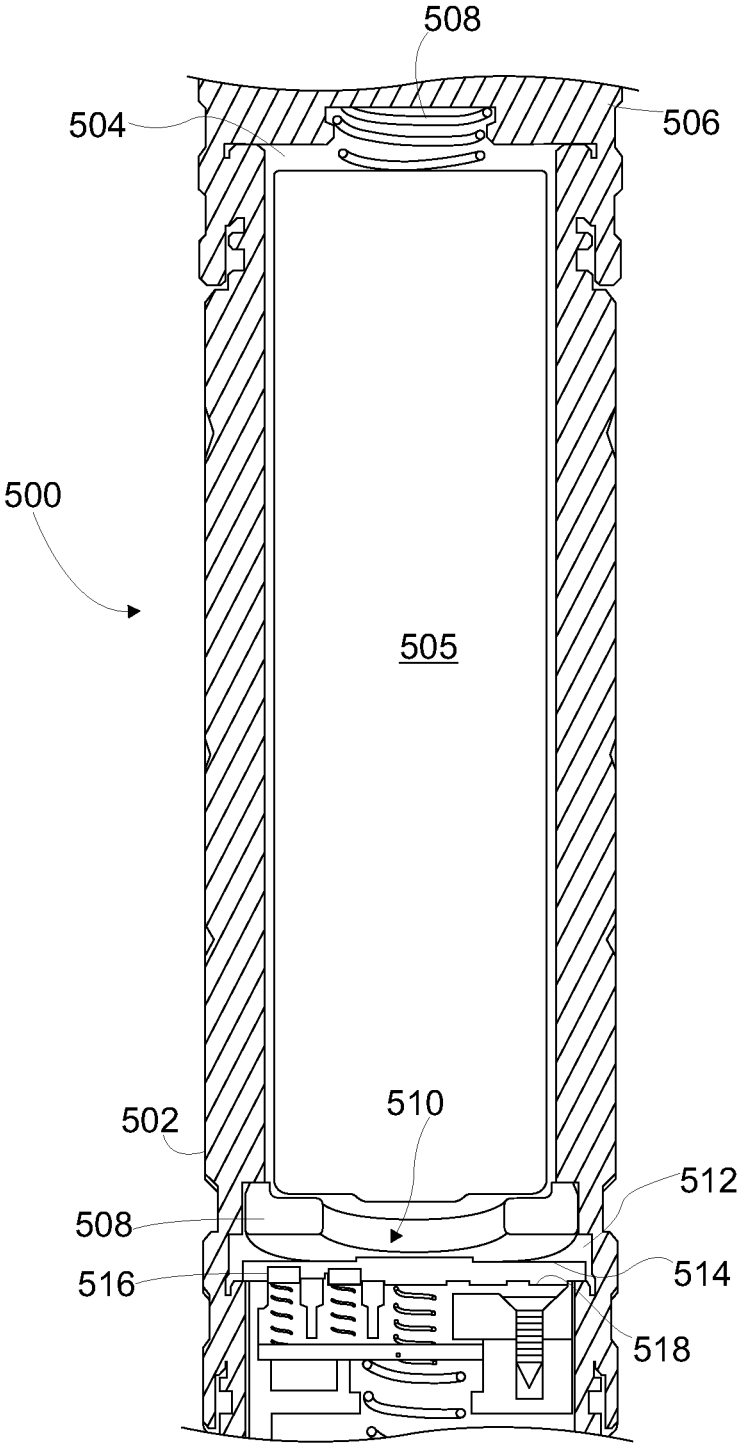
FIGS. 5D and 5E illustrate more detailed embodiments of the modular extension unit of FIG. 5C.
Figure 5E:
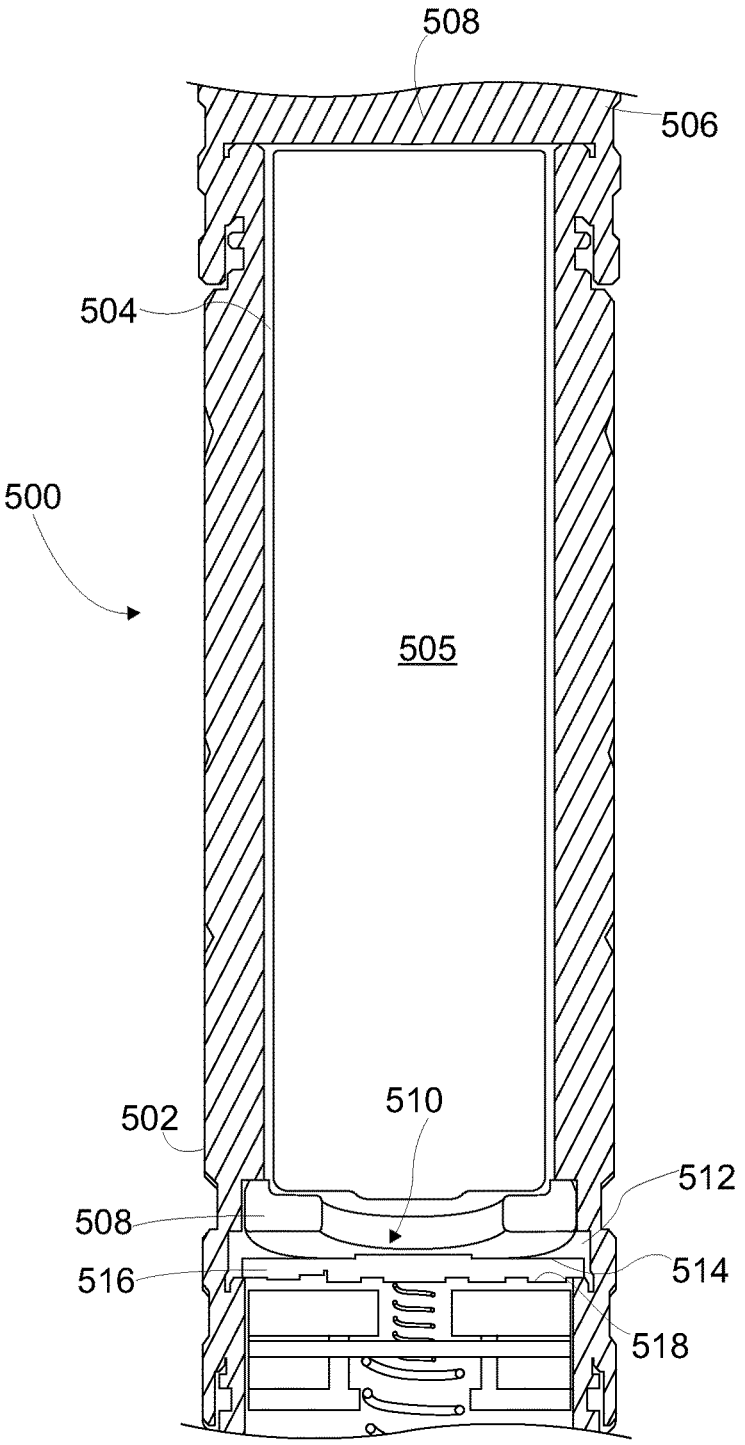
Figure 6A:
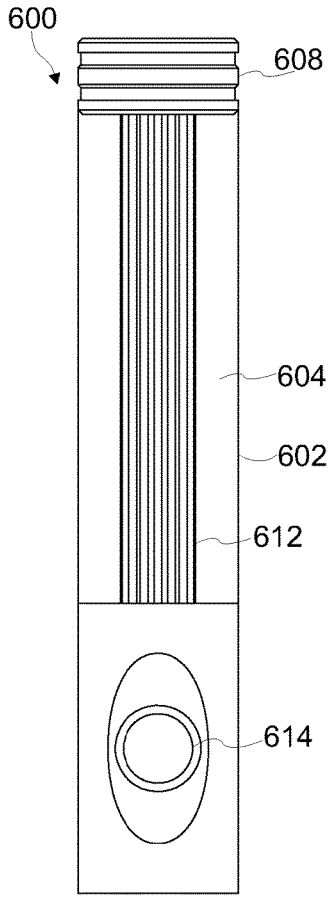
FIGS. 6A and 6B illustrate side and perspective views, respectively, of another embodiment of a modular extension unit that may be used with the flashlight of FIG. 1A.
Figure 6B:
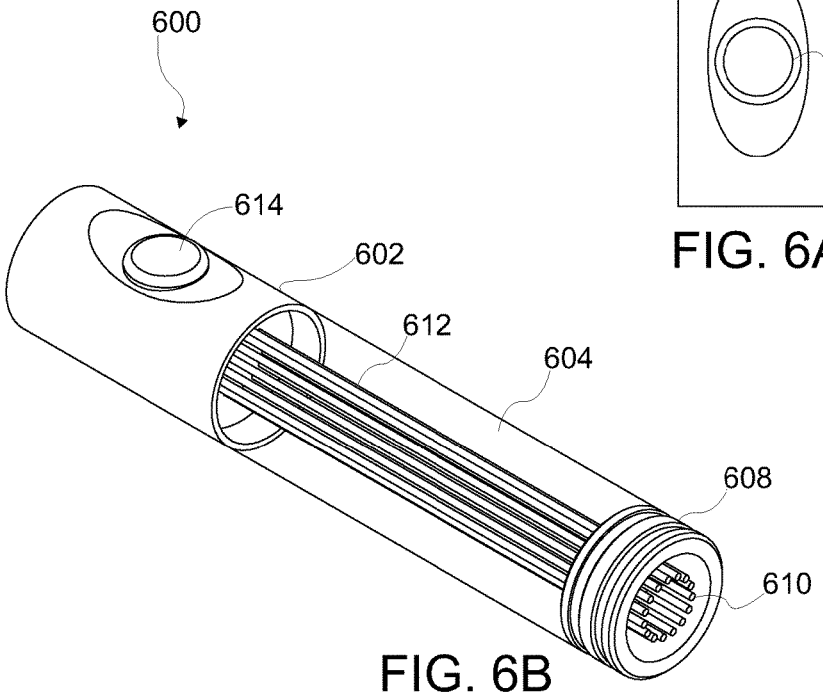
Figure 6C:
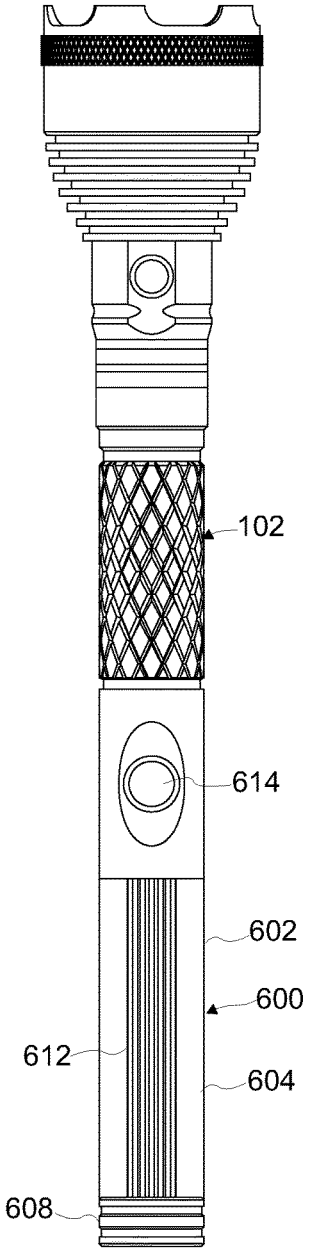
FIGS. 6C and 6D illustrate side and cross-sectional views, respectively, of embodiments of the modular extension unit of FIGS. 6A and 6B coupled to the flashlight of FIG. 1A.
Figure 6D:
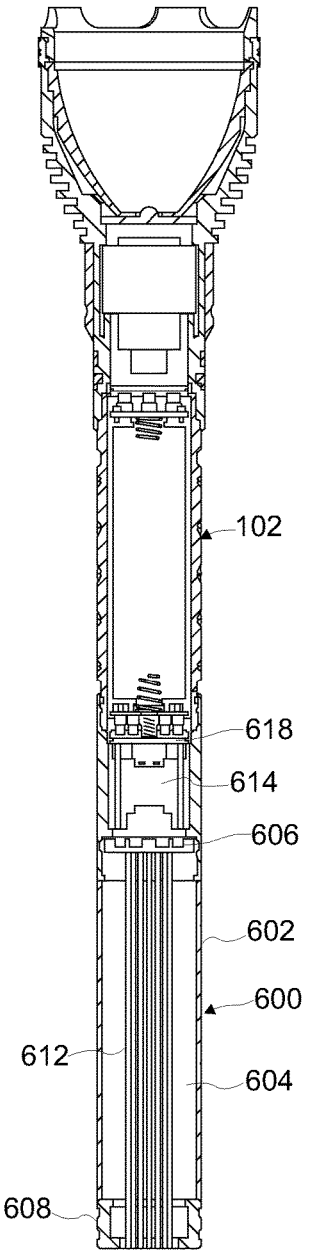
Figure 6E:
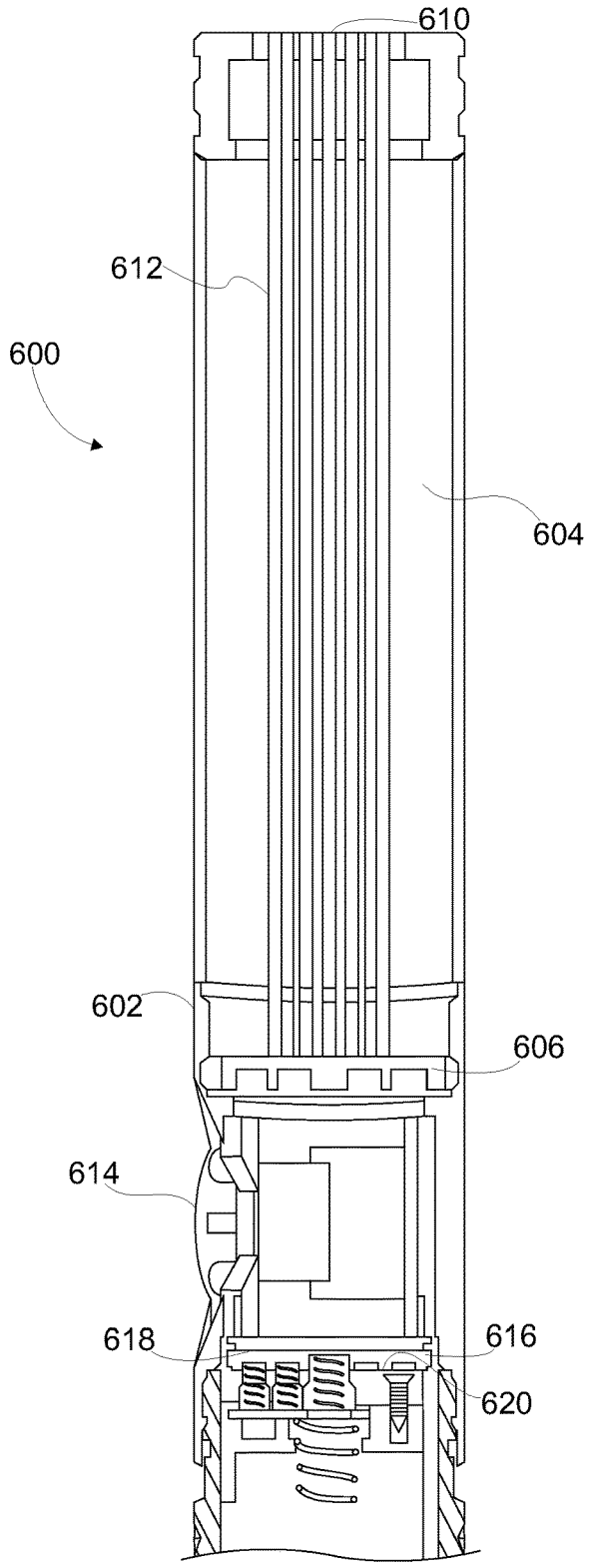
FIGS. 6E and 6F illustrate more detailed embodiments of the modular extension unit of FIG. 6D.
Figure 6F:
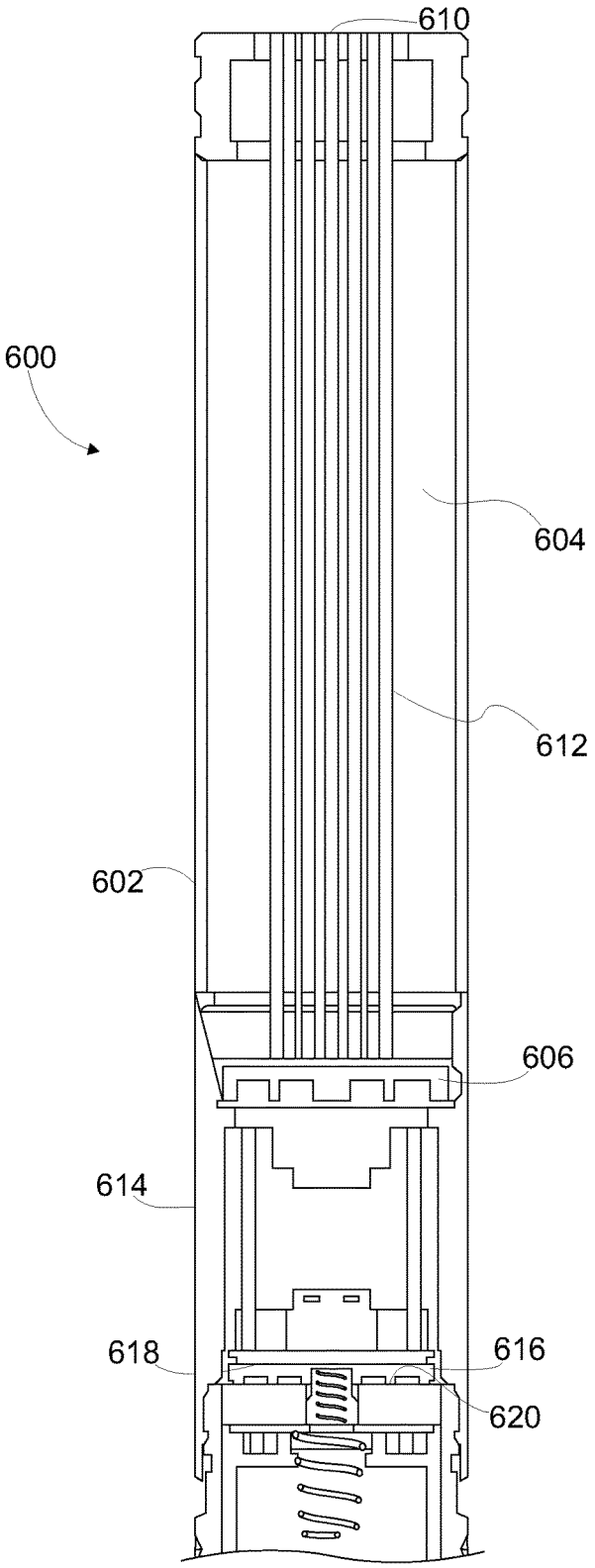
Figure 7A:
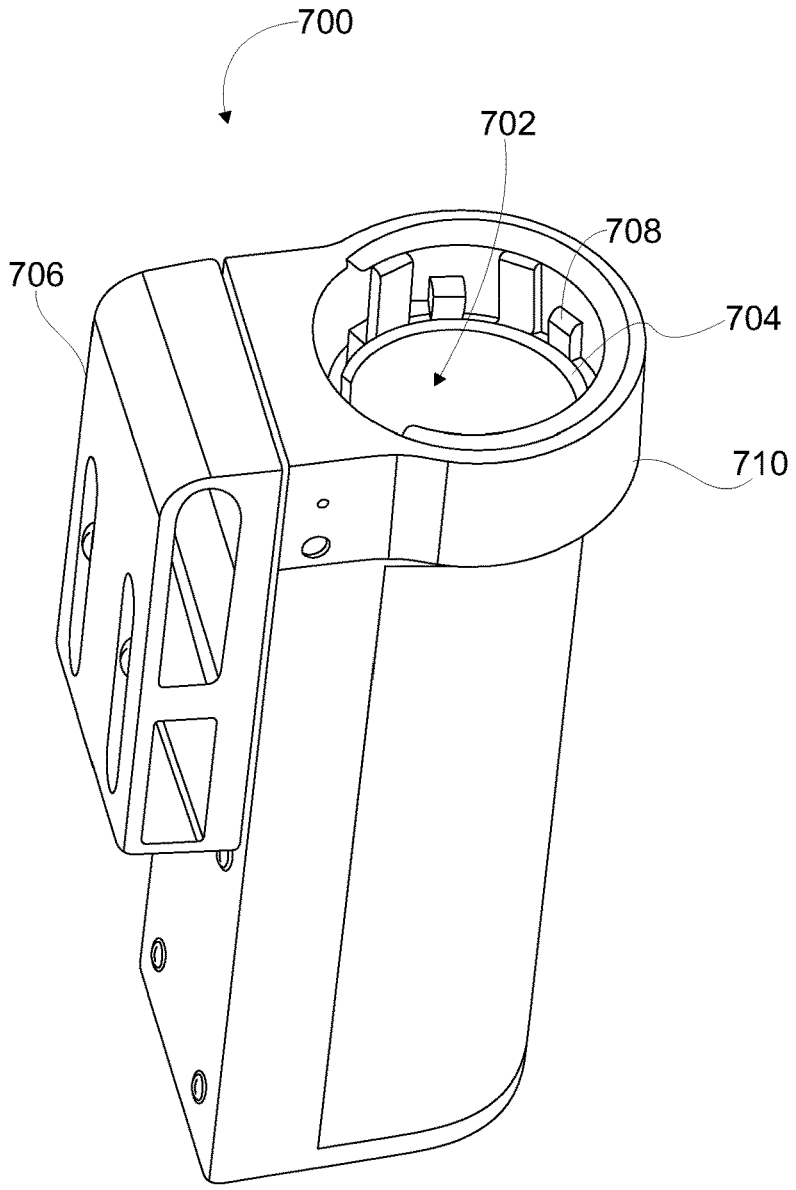
FIG. 7A illustrates a perspective view of one embodiment of a retention device that may be used with the flashlight of FIG. 1A.
Figure 7B:
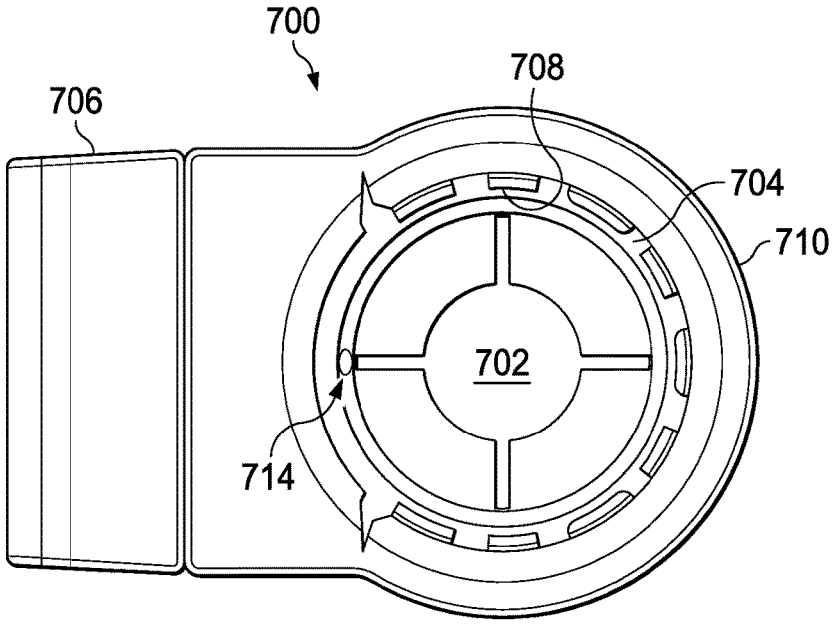
FIG. 7B illustrates a top view of one embodiment of the retention device of FIG. 7A.
Figure 7C:
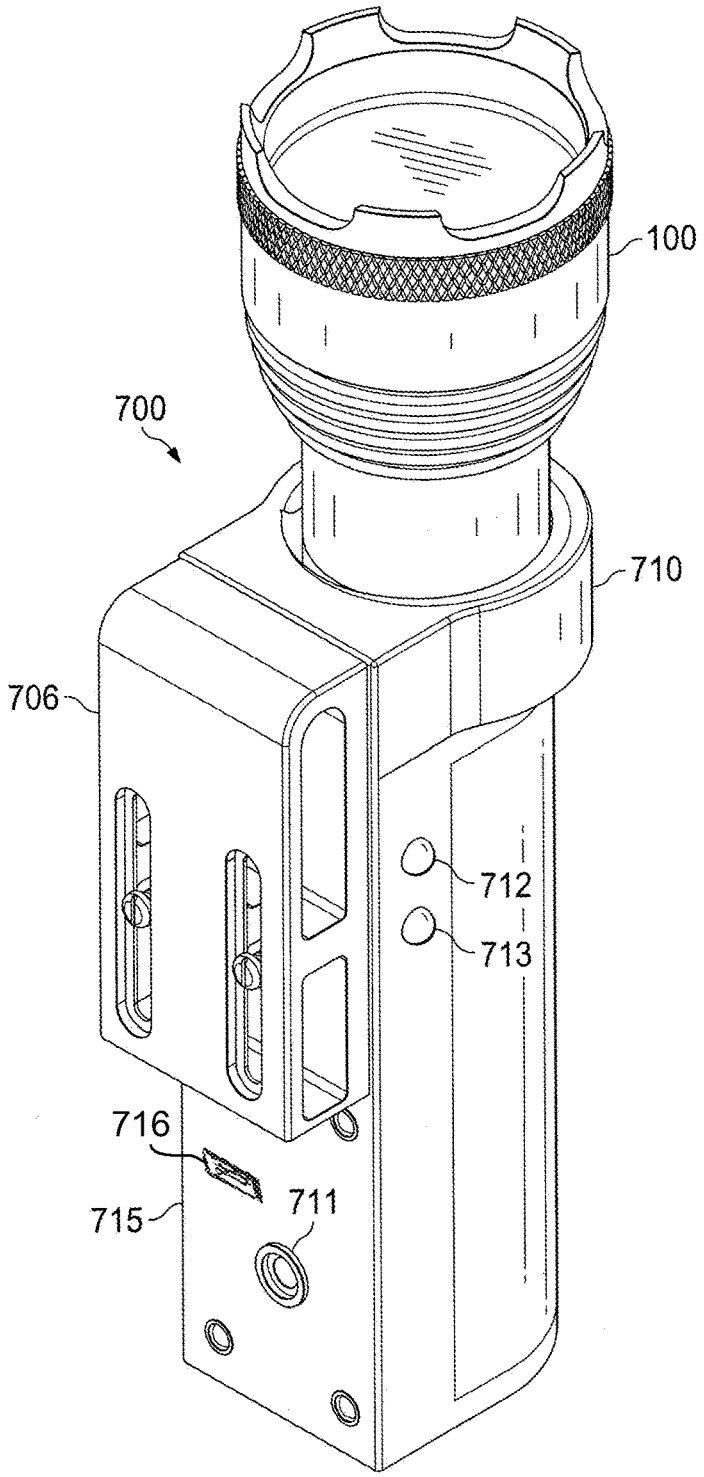
FIG. 7C illustrates a perspective view of one embodiment of the retention device of FIG. 7A retaining the flashlight of FIG. 1A.
Figure 7D:
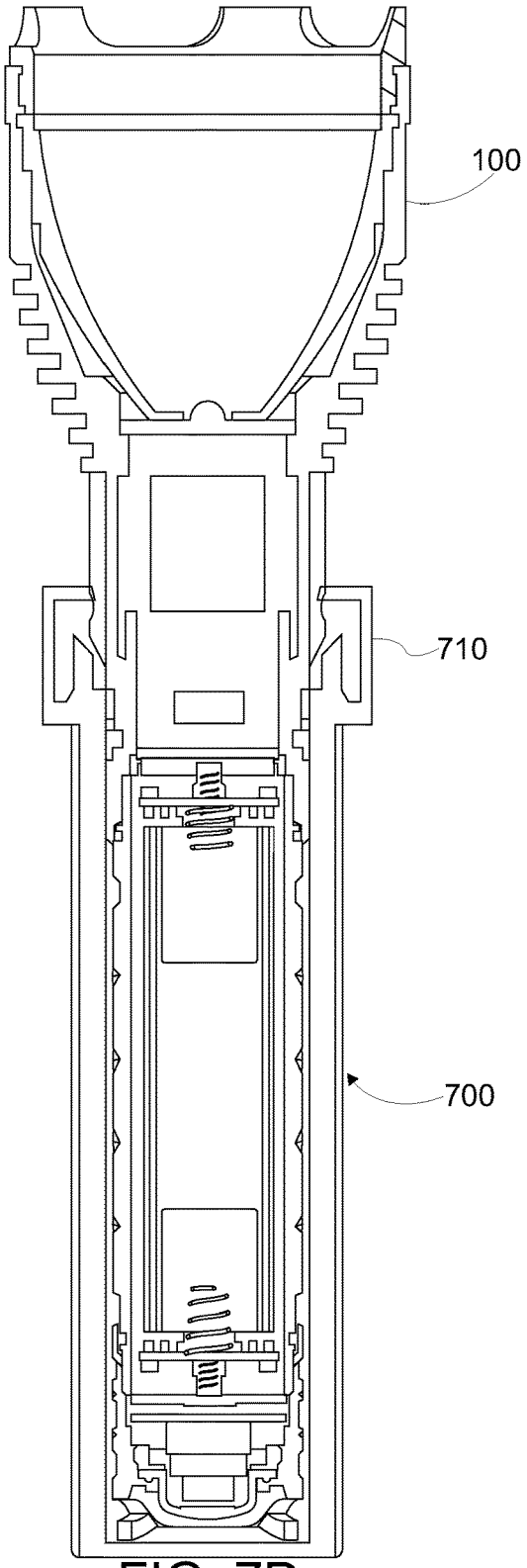
FIG. 7D illustrates a cross-sectional view of one embodiment of the retention device of FIG. 7A retaining the flashlight of FIG. 1A.
Figure 8A:
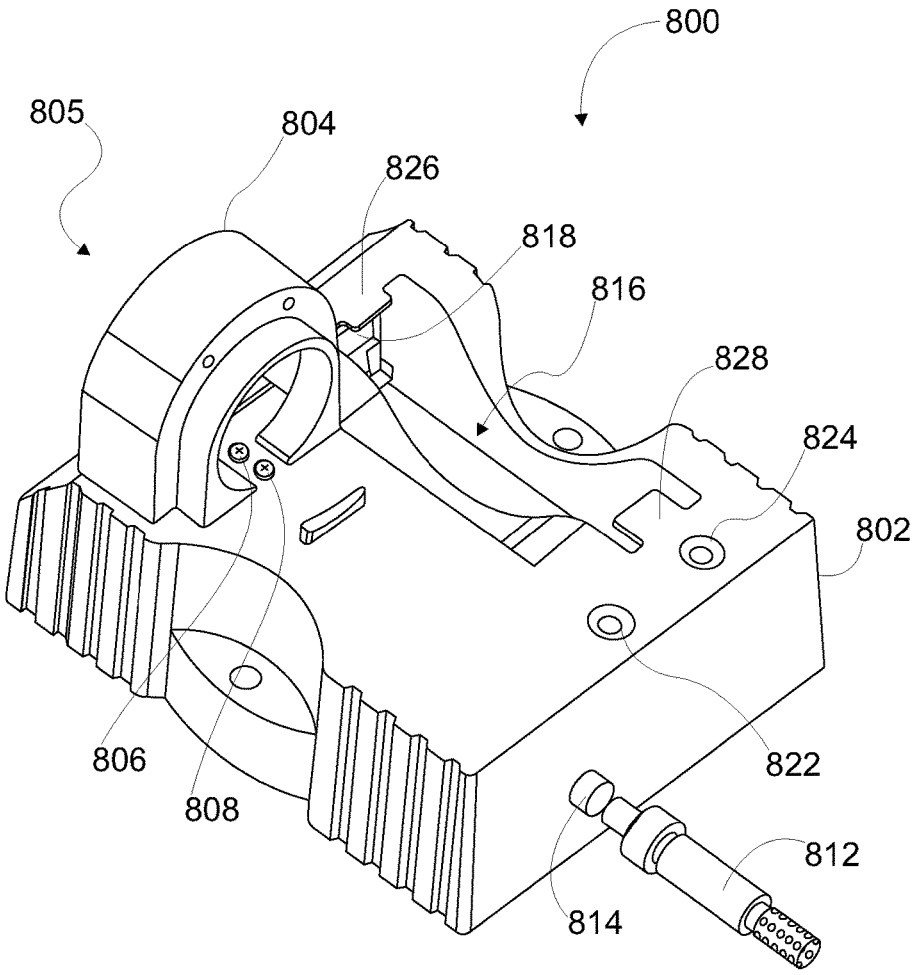
FIGS. 8A and 8B illustrate perspective views of embodiments of a recharging unit that may be used with the flashlight of FIG. 1A.
Figure 8B:
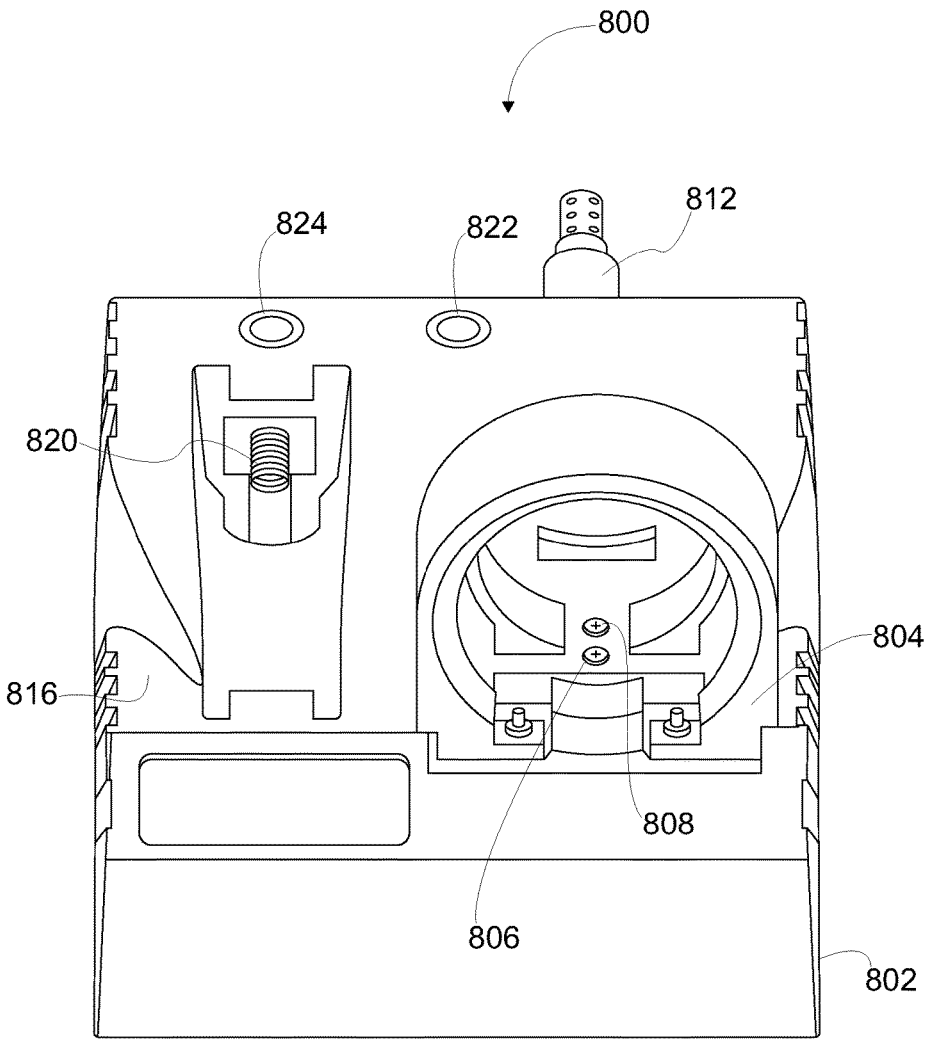
Figure 8C:
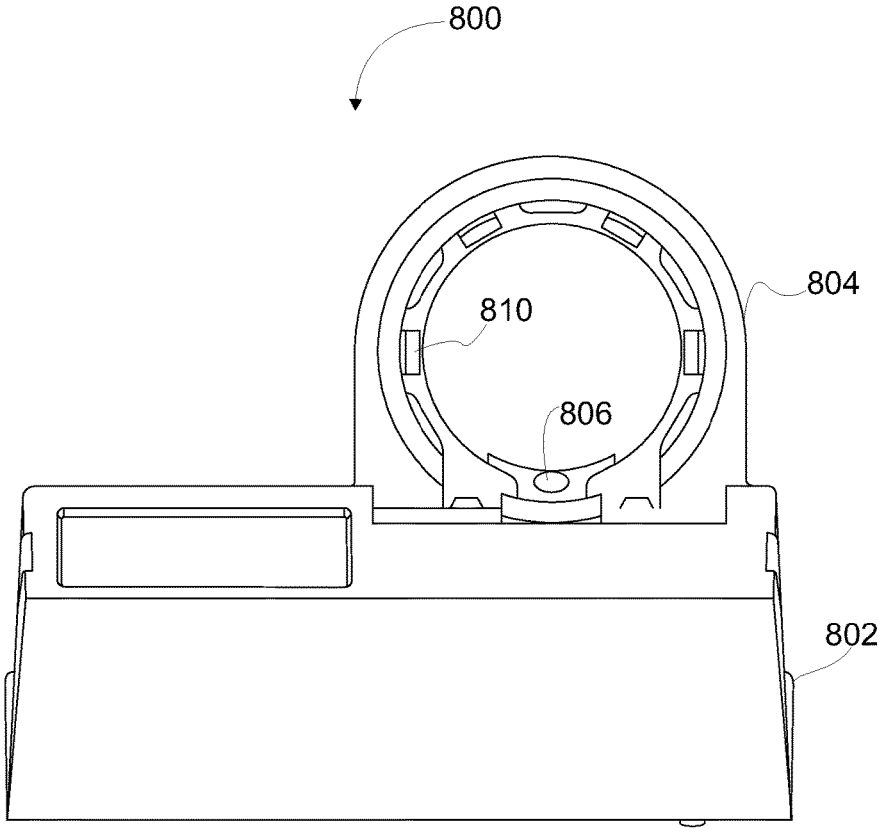
FIG. 8C illustrates a side view of one embodiment of the recharging unit of FIGS. 8A and 8B.
Figure 8D:
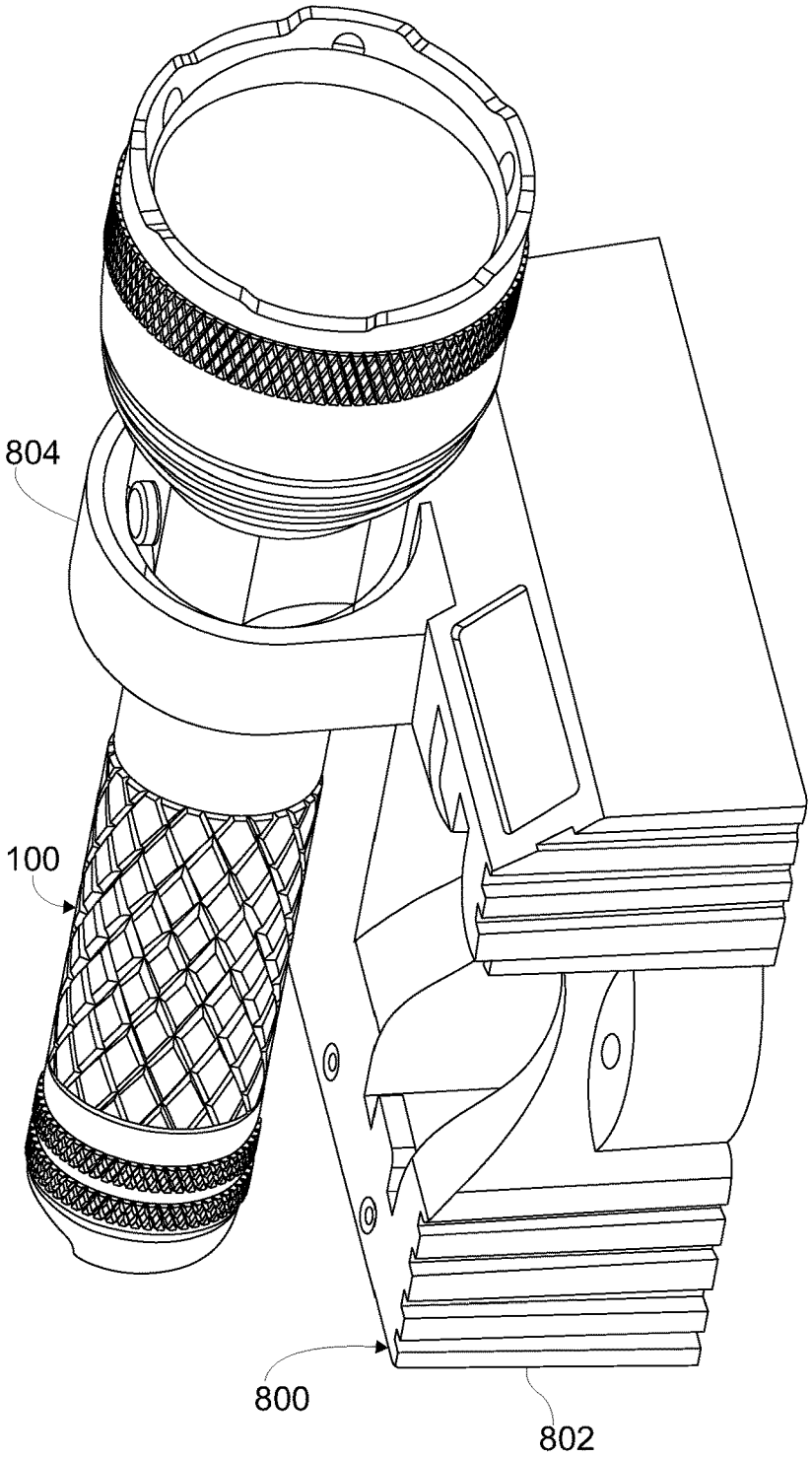
FIGS. 8D and 8E illustrate perspective views of embodiments of the recharging unit of FIGS. 8A and 8B with the flashlight of FIG. 1A.
Figure 8E:
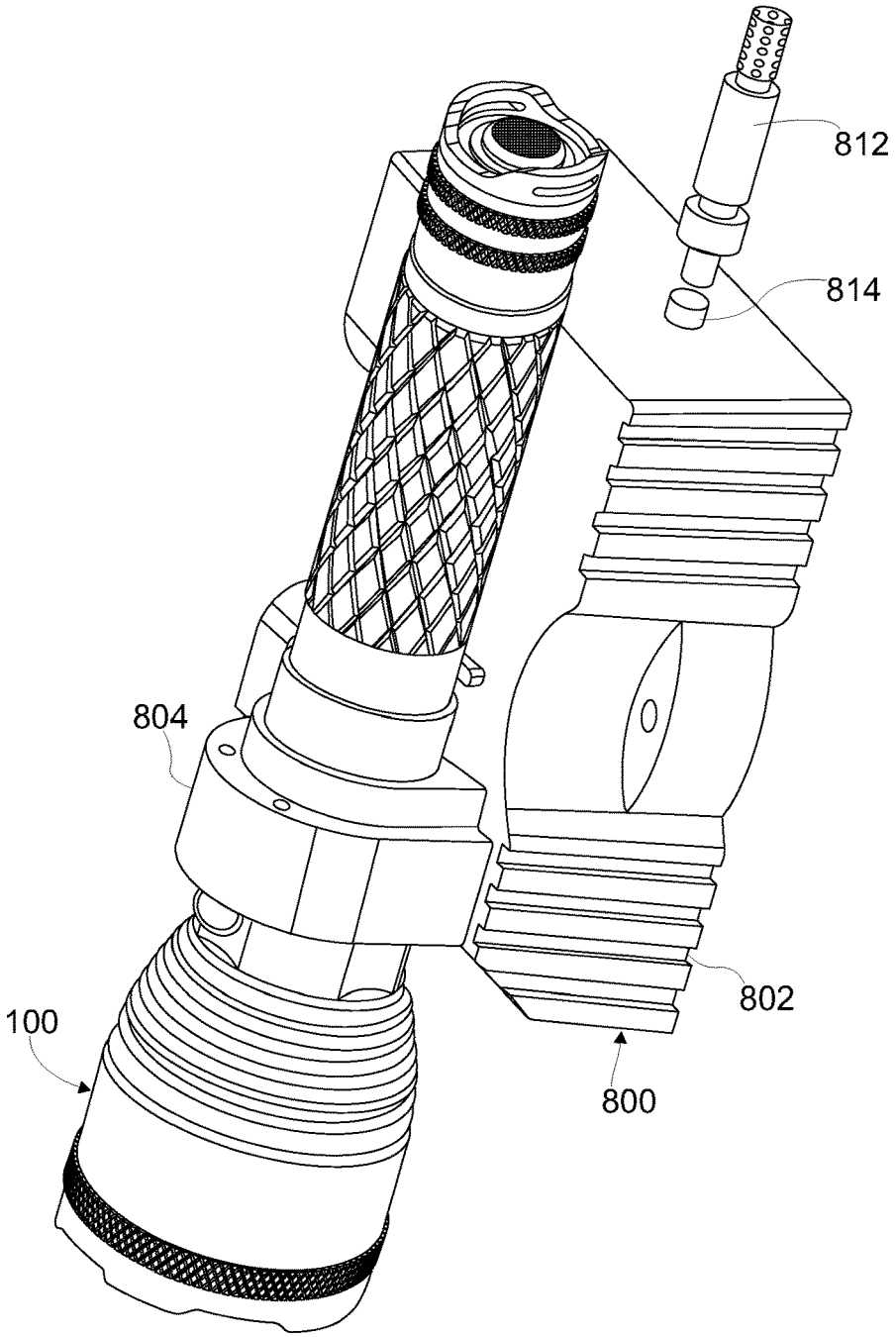
Figure 8F:
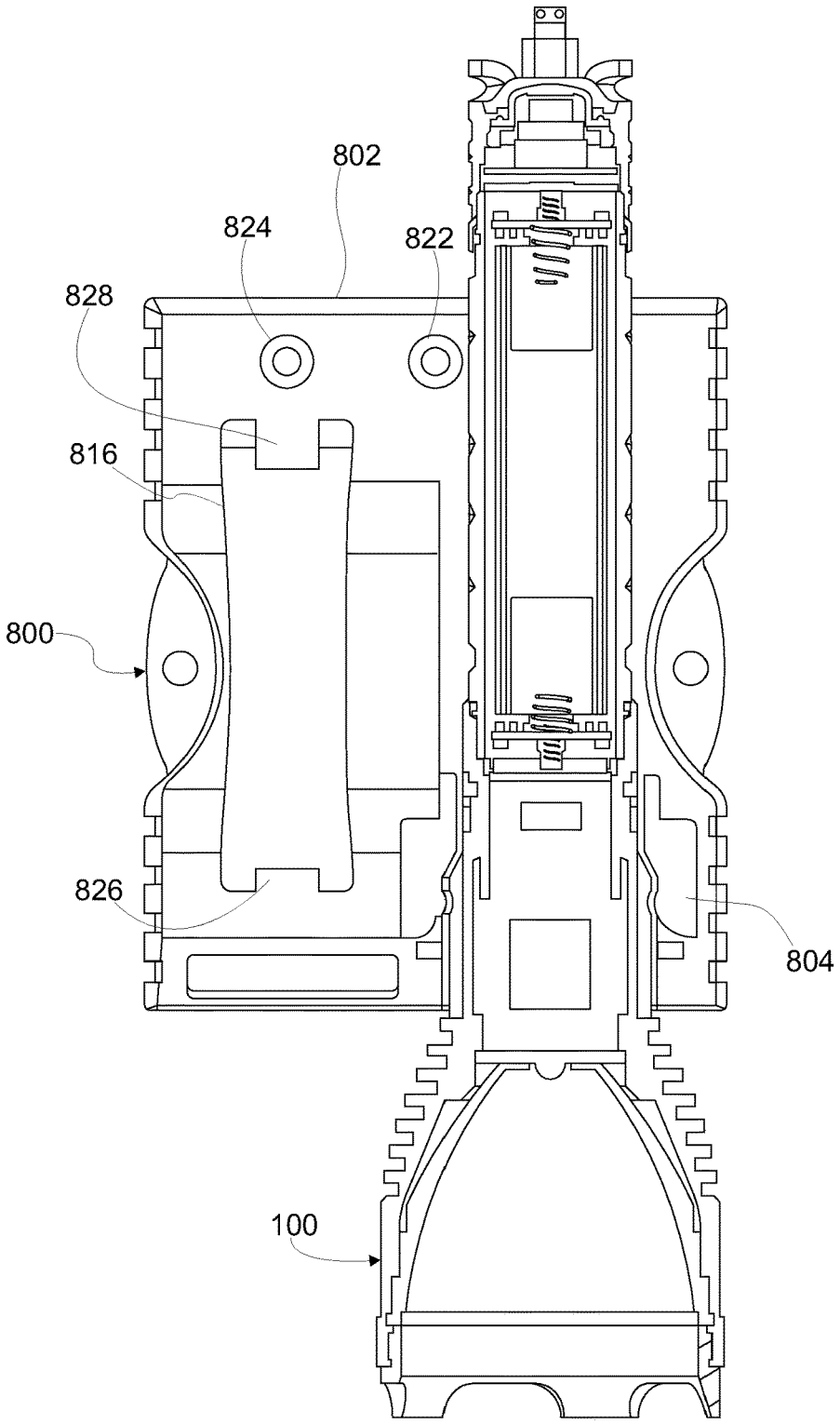
FIG. 8F illustrates a top cross-sectional view of one embodiment of the recharging unit of FIGS. 8A and 8B with the flashlight of FIG. 1A.

Referring to FIG. 4, a diagram illustrates one non-limiting embodiment of a circuit 400 that may be used with the flashlight 100 of FIG. 1. It is understood that the circuit 400 is provided for purposes of example and that many different circuits may be used to provide some or all of the functionality described herein for the flashlight 100. In one embodiment, the two switches 106 (SW2) and 110 (SW1) are double pole, single throw switches and sensor 122 is a Reed switch. LED 112 is controlled by the switch positions and logic provided by integrated circuits 402 and 404, which drive LED 112 via transistor Q1. Direct current (DC) input at J1 may be approximately 4.5 volts and 1 amp, VCC may be approximately 3.7V and 2800 mAh, and VDD may be approximately 2.5V-3.3V. It is understood that these values are for purposes of example only, and that the circuit 400 may be designed for other values of voltage and/or current.

Referring to FIGS. 5A-5E, one embodiment of the flashlight 100 of FIG. 1 is illustrated with a modular extension unit 500. In one embodiment, the modular extension unit 500 provides an additional power source for the flashlight 100. The modular extension unit 500 replaces the tail cap 108 and attaches to the housing 102 in the same manner as the tail cap 108. For example, if the tail cap 108 is threadably engaged to the housing 102, then the modular extension unit 500 will threadably engage to the housing 102. This enables the modular extension unit 500 to be quickly brought into service without the need to reconfigure the flashlight 100 from its base configuration except for removal of the tail cap 108.

The modular extension unit 500 includes a substantially cylindrical housing 502 that contains a cavity 504 that is accessed by removing a module tail cap 506. The cavity 504 is sized to receive one or more batteries 505, such a Li-ion battery. The module tail cap 506 may include a spring 508 that may both ensure that the battery 505 is secured against a contact on the opposite end and serve as an electrical terminal for the negative end of the battery 505 (or positive end if the modular extension unit is designed to receive the battery in a different manner).

On the opposite end, the modular extension unit 500 is similar to the end cap 108. Accordingly, a retention member 508 is positioned to retain the battery 505 in the cavity 504. The retention member 508, which may itself be conductive or include conductive traces, may include an opening 510. The retention member 508 may form a cavity 512 with an upper surface 514 of a lower member 516, although this cavity may not exist in other embodiments. The upper surface 514 may include one or more contacts to engage a terminal of the battery 505. A lower surface 518 of the lower member 516 is configured to electrically engage the battery holder 116. Accordingly, the lower surface 518 includes three separate contacts (e.g., partial or complete concentric metal circles) that are positioned to engage opposing contacts on the battery holder 116. Accordingly, power may flow from the battery 505 through the contacts to the battery holder 116. As with the tail cap 108, various contacts and traces provided by the modular extension unit 500 are needed to complete the main circuit for the LED 112.

Referring to FIGS. 6A-6F, one embodiment of the flashlight 100 of FIG. 1 is illustrated with an optional modular extension unit 600. In one embodiment, the modular extension unit 600 provides an additional light source for the flashlight 100. The modular extension unit 600 replaces the tail cap 108 and attaches to the housing 102 in the same manner as the tail cap 108. For example, if the tail cap 108 is threadably engaged to the housing 102, then the modular extension unit 600 will threadably engage to the housing 102. This enables the modular extension unit 600 to be quickly brought into service without the need to reconfigure the flashlight 100 from its base configuration except for removal of the tail cap 108.

The modular extension unit 600 includes a substantially cylindrical housing 602 that contains a cavity 604. The cavity 604 contains one or more light sources (e.g., LEDs) (not shown) on a substrate 606. In the present embodiment, the LEDs are positioned to project light parallel to a longitudinal axis of the housing 602. A tail cap 608, which may or may not be removable, may include at least a portion 610 (e.g., a window) formed from a material (e.g., a transparent or translucent plastic) that allows the passage of light (represented by light beams 612), thereby enabling light projected by the LEDs to exit the tail cap 608. Some or all of the housing 602 wall may also be formed of a material (e.g., a transparent or translucent plastic) that enables light to pass. It is understood that varying the amount and/or location of the material within the wall enables many different lighting needs to be met. Furthermore, by varying the color of the LEDs and/or the color of the material, different colors of lights may be provided.

The modular extension unit 600 includes a switch 614 that may be used to actuate the LEDs in the modular extension unit 600. The switch 614 may be configured as previously described with respect to switches 106 and 110 (e.g., with multiple states and pressure sensitivities) or may be differently configured. For example, the switch 614 may be used to toggle the LEDs through an OFF state, a CONSTANT ON state, and a STROBE state.

Power for the modular extension unit 600 is obtained from the battery contained in the battery compartment or battery holder 116. Accordingly, the modular extension unit 600 includes a lower member 616 that has an upper surface 618 facing the switch 614 and a lower surface 620 facing the battery holder 116. The lower surface 620 is configured to electrically engage the battery holder 116. Accordingly, the lower surface 620 includes three separate contacts (e.g., partial or complete concentric metal circles) that are positioned to engage opposing contacts on the battery holder 116. In some embodiments, actuation of the switch 614 may simply connect/disconnect power to the LEDs without use of the controller board 118. In other embodiments, actuation of the switch 614 may cause a signal to be sent to the controller board 118 and the controller board 118 may handle activation/deactivation of the LEDs.

It is understood that many other modular extension units may be used with the flashlight 100 of FIG. 1. For example, another modular extension unit may provide infrared signaling/marking functionality that could be used to signal or provide a point of reference for a human or for another device equipped with infrared optics. Yet another modular extension unit may provide passive ethyl-alcohol detection functionality that could be used to detect small amounts of ethyl-alcohol in the ambient air and provide a visual and/or audible alert when detection occurs. Still another modular extension unit may provide a chemical (e.g., Oleoresin Capsicum (OC)) dispersing functionality that could be used to provide personal protection by releasing a metered amount of OC or another chemical or compound to a specific targeted area. Another modular extension unit may provide electrical stun functionality that could be used to provide personal protection by disrupting a target person's internal electrical communication system using high-voltage, low-ampere electrical pulses. Furthermore, in some embodiments, modular extension units may be coupled to one another (e.g., stacked) to provide multiple functions. In still other embodiments, a single modular extension unit may provide multiple functions. In other embodiments, a modular extension unit may provide some or all of its own power.

In another embodiment an extension unit is configured to provide personal protection by disrupting a target person's internal electrical communication system using high-voltage, low-ampere electrical pulses. The extension unit's lower surface is electrically configured to engage battery holder 116 or other stand-alone battery. The extension unit's top surface contains a pressure switch, containing a switch action movement parallel to the extension housing, and a positive and negative electrical terminal. During depression of the pressure switch, the extension unit's controller electrically transforms and directs energy from the battery holder and battery, or stand-alone battery, to the exposed electrical terminals. This enables a user, for the purpose of personal protection, to push the flashlight 100, with this extension unit affixed, into another person or animal so that the top side of this extension unit contacts the person or animal and with enough force to depress the pressure switch. The high voltage low ampere current will disrupt the threatening person's or animal's internal electrical communication system.

Referring to FIGS. 7A-7D, one embodiment of a retention device 700 (e.g., a holster) is illustrated. The holster 700 includes a receptacle 702 for receiving the housing 102 of the flashlight 100 so that the head 104, which is wider than the housing 102, engages a lip 704 and stops the flashlight 100 from sliding through. The holster 700 may have an opening at the bottom to prevent debris and moisture from accumulating and, in some embodiments, to allow the flashlight 100 to be properly holstered when a modular extension unit is attached. A clip 706, which may be adjustable, is provided for attachment to a belt or other available attachment point. When fully inserted into the holster 700, protrusions 708 may engage the notches 128 (FIGS. 1A and 1B) and ensure that the flashlight 100 is not easily dislodged from the holster 700 during physical activity by the user. It is understood that while the present embodiment uses the combination of protrusions and notches to achieve secure storage, other methods may be used (e.g. magnetic attraction, a lever clamp, etc.) Although not shown, a magnet or other component (e.g., an RFID tag) may be attached to or embedded within the holster 700 to actuate the previously described sensor 122. For example, the magnet may be embedded in a collar 710.

In another embodiment, the retention device 700 includes a charging circuit board 715, in some embodiments, a rechargeable battery technology (e.g., a li-ion, li-polymer). This embodiment allows a user to charge the flashlight while the flashlight is retained on their person using both a constant connection to a power source (e.g. sitting in a vehicle), or stored energy if equipped with a rechargeable battery. The flashlight 100 is placed into the receptacle 702 until the two contacts 714 securely engage the contacts 124 and 126 on the flashlight 100. In the present embodiment, the notches 128 engage protrusions 708 on the interior of the receiving receptacle 702 to achieve secure placement, but it is understood other methods may be used (e.g. magnetic attraction, a lever clamp, etc.). The contacts 714, coupled to circuit board 715, may be additionally coupled with an external power source (not shown), in some embodiments, a rechargeable battery technology, which is provided power via a power receptacle 711 on the posterior surface of the retention device 700. The power receptacle 711 accepts a power source which is shaped to match the electrical contact configuration in receptacle 711. In this example, position of the power source connection to receptacle 711 is maintained using magnetic attraction, allowing for quick disconnection. It is understood that the position of the power receptacle 711 may be located in a different position on the retention device 700 in some embodiments. For example, the power receptacle may be positioned on the side of the retention device 700. It is also understood that the shape and electrical contact configuration may be arranged differently (e.g. plug and socket).

In another embodiment, the retention device 700 includes a switches internally coupled with a light source (e.g. Light Emitting Diode (LED)) 712 and 713, which display battery charge level information to the user when pressure is applied to the switch. Upon pressure application to switch 712, its internal light source will illuminate GREEN to display full-charge status, YELLOW to display partial-charge status, or RED to display diminished capacity of the flashlight's 100 internal battery. Upon pressure application to switch 713, its internal light source will illuminate GREEN to display full-charge status, YELLOW to display partial-charge status, or red to display diminished capacity of the retention device's 700 internal battery if equipped. When a power source is providing charging circuit 715 with power via power receptacle 711, the internal light source to push button 712 and 713 will remain illuminated until the connection to the power source is removed. It is understood that in this example, switch 712 displays battery charge status of the flashlight 100, and switch 713 displays battery charge status of the retention device's 700 internal battery. In other embodiments, only one switch may be present (e.g. in the absence of an internal battery function), or switch 713 may display internal battery status instead of flashlight battery charge status. It is also understood that this example uses a light source to display battery charge status information, but other embodiments may use other visual methods to display battery charge status such as LCD displays, electrophoretic ink, etc. It is also understood that the position of the switch may be positioned at a different location on retention device (e.g. top surface, posterior surface, etc.). In this example, the switch and visual display method are coupled. It is understood that in some embodiments, a switch and visual display method may be located on retention device 700 in separate locations.

In another embodiment, the retention device, when also equipped with a rechargeable battery, includes a female power output receptacle in a common Universal Serial Bus (USB) arrangement 716 coupled to the charging circuit 715, which can deliver sufficient electrical charge to recharge a mobile telephone battery or other USB compatible device battery. The void space in the USB receptacle is covered and sealed using an attached rubber gasket, which is sized to occupy the void space, which is purposed to prevent water, dust, debris etc. from entering the USB receptacle. It is understood that the position of the USB receptacle may vary.

Referring to FIGS. 8A-8F, one embodiment of a recharging unit 800 is illustrated. The recharging unit 800 includes a base 802 that supports a receiving ring 804. The receiving ring 804 is sized to receive the housing 102 of the flashlight 100. The flashlight 100 is placed into the receiving ring 804 in the direction of arrow 805 until the notches 128 engage protrusions 810 on the interior of the receiving ring 804. The notches 128 and protrusions 810 ensure that two contacts 806 and 808 engage the contacts 124 and 126 on the flashlight 100. The contacts 806 and 808 may be coupled to an external power source (not shown), which is accessed by the recharging unit 800 via a power cord 812 that engages a power receptacle 814 in the base 802.

The base 802 may also include an indention or other designated area 816 for the battery holder 116 or a rechargeable battery. In one embodiment, the indention 816 includes a positive terminal 818 and a negative terminal 820 that may be coupled to the external power source via the power cord 812. Tabs 826 and 828 may aid in securing the battery holder 116 or battery within the indention 816. Lights 822 and 824 may indicate current charge state via color changes and/or other visual indicators, such as blinking/steady. For example, light 822 may indicate the charge state of the flashlight 100 and light 824 may indicate the charge state of the battery in the indention 816.

The base 802 and/or receiving ring 804 may include a magnet (not shown) positioned for detection by the sensor 122. This prevents inadvertent activation of the flashlight 100 while the flashlight is positioned in the recharging unit 800.

It will be appreciated by those skilled in the art having the benefit of this disclosure that this modular flashlight and modular flashlight system provide a basic flashlight configuration that may be extended using modular extension units. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A flashlight system, comprising:

a housing with a first end and a second end;

a retention device configured to interface with and contain the housing;

a light source disposed at a first end of the housing;

a controller configured to toggle an output mode of the light source between at least an on state and an off state;

a first switch electrically coupled to the controller, configured to provide an input signal to the controller to toggle the light source between at least the on state and the off state; and a sensor electrically coupled to the controller, wherein the sensor is configured to detect a presence of a component matched to the sensor by detection of a magnetic field of the component, the component positioned in the retention device such that the sensor does not contact the component, and wherein the sensor is configured to provide an input signal to the controller to store an operating on/off state into memory upon detection of a component matched to the sensor being in proximity to the sensor, and upon removal of the housing from the retention device resulting in the component matched to the sensor being moved out of proximity to the sensor, the controller returning the light source to the stored operating on/off state.

2. The flashlight system of claim 1 wherein a retention device is configured to removably receive the housing so that the sensor is positioned proximate to the component matched to the sensor when the housing is received into the retention device.

3. The flashlight system of claim 2 wherein a tail cap is configured to removably couple to the second end of the housing, wherein a second switch is configured to toggle the light source between at least an on state and an off.

4. The flashlight system of claim 1 wherein the controller is additionally configured to toggle the light source to a user-defined on/off state and output mode upon removal of the component matched to the sensor.

5. The flashlight system of claim 1 wherein a tail cap is configured to removably couple to the second end of the housing, wherein a second switch is configured to toggle the light source between at least an on state and an off.

6. A retention device operable to interact with a flashlight having a sensor, comprising:

a receptacle for receiving the flashlight, the receptacle having a lip to prevent the flashlight from sliding through; and a component matched to the sensor, for interacting with the sensor of the flashlight, wherein the component matched to the sensor provides a magnetic field detectable by the sensor, such that the sensor can control at least one of an on state and an off state of a light source of the flashlight when in proximity to the retention device, wherein the component matched to the sensor is positioned in the retention device such that the sensor does not contact the component matched to the sensor, and wherein the sensor is configured to provide an input signal to store an operating on/off state into memory upon detection of a component matched to the sensor in proximity to the sensor, and, upon removal of the flashlight from the retention device resulting in the component matched to the sensor being moved out of proximity to the sensor, return the flashlight to the stored operating on/off state.

7. A retention device comprising:

a receptacle for receiving a flashlight, the flashlight including a sensor;

an electric current delivery system to charge a flashlight battery within the retention device;

a power receptacle for receiving power from a power source external to the retention device;

a component matched to the sensor, for interacting with the sensor of the flashlight, wherein the component matched to the sensor provides a magnetic field detectable by the sensor, such that the sensor can control at least one of an on state and an off state of a light source of the flashlight when in proximity to the retention device, wherein the component matched to the sensor is positioned in the retention device such that the sensor does not contact the component matched to the sensor, and wherein the sensor is configured to provide an input signal to store an operating on/off state into memory upon detection of a component matched to the sensor in proximity to the sensor, and, upon removal of the flashlight from the retention device resulting in the component matched to the sensor being moved out of proximity to the sensor, return the flashlight to the stored operating on/off state; and a visual indicator for displaying a charging status of the flashlight battery.

8. The retention device of claim 7 further comprising:

a charging circuit board.

9. The retention device of claim 8 further comprising a female power output receptacle in a common Universal Serial Bus (USB) arrangement coupled to an internal battery.

10. A modular flashlight system, comprising:

a first housing with a first end and a second end;

a retention device configured to interface with and contain the first housing;

a light source disposed at the first end of the first housing;

a controller configured to toggle the light source between at least an on state and an off state; and a first switch electrically coupled to the controller, configured to provide an input signal to the controller to toggle the light source between at least the on state and the off state;

a sensor electrically coupled to the controller, wherein the sensor is configured to:

detect a presence of a component matched to the sensor by detection of a magnetic field of the component, the component positioned in the retention device such that the sensor does not contact the component, and wherein the sensor is configured to provide an input signal to the controller to store an operating on/off state into memory upon detection of a component matched to the sensor being in proximity to the sensor, and upon removal of the first housing from the retention device resulting in the component matched to the sensor being moved out of proximity to the sensor, the controller returning the light source to the stored operating on/off state; and a modular extension unit having a second housing with a third end and a fourth end, wherein the third end is configured to removably couple to the second end of the first housing, wherein the second housing is configured to complete the circuit to provide power to the light source, wherein only one of a tail cap and the second housing can be coupled to the second end at a particular time.

11. A modular flashlight system, comprising:

a first housing with a first end and a second end;

a retention device configured to interface with and contain the first housing;

a first light source disposed at the first end of the first housing;

a second housing removably coupled to the first housing, and having a second light source;

a controller configured to toggle at least one of the first light source and the second light source between at least one of an on state and an off state;

a sensor electrically coupled to the controller, wherein the sensor is configured to:

detect a presence of a component matched to the sensor by detection of a magnetic field of the component, the component positioned in the retention device such that the sensor does not contact the component, and wherein the sensor is configured to provide an input signal to the controller to store an operating on/off state into memory upon detection of a component matched to the sensor being in proximity to the sensor, and upon removal of the first housing from the retention device resulting in the component matched to the sensor being moved out of proximity to the sensor, the controller returning the at least one of the first light source and the second light source to the stored operating on/off state;

a first switch electrically coupled to the controller, configured to provide an input signal to the controller to toggle at least one of the first light source and the second light source between at least one of the on state and the off state; and a second switch configured to toggle at least one of the first light source and the second light source between at least one of the on state and the off state independently of the first switch.

* * * * *